United States Patent [19]

Ronnen et al.

[11] 4,245,162

[45] Jan. 13, 1981

[54] STEAM TURBINE POWER PLANT HAVING IMPROVED TESTING METHOD AND SYSTEM FOR TURBINE INLET VALVES ASSOCIATED WITH DOWNSTREAM INLET VALVES PREFERABLY HAVING FEEDFORWARD POSITION MANAGED CONTROL

[75] Inventors: Uri G. Ronnen, Monroeville; Francesco Lardi, Pittsburgh, both of Pa.

[73] Assignee: Westinghouse Electric Corp., Pittsburgh, Pa.

[21] Appl. No.: 388,534

[22] Filed: Aug. 15, 1973

[51] Int. Cl.[2] ..... F02N 11/06

[52] U.S. Cl. ..... 290/40 R; 364/494; 60/660

[58] Field of Search ..... 290/2, 52, 40; 60/105, 60/660–667; 235/151.21; 364/494, 492

[56] References Cited

U.S. PATENT DOCUMENTS

| | | | |
|---|---|---|---|
| 3,163,813 | 12/1964 | Oldenburger | 318/620 |
| 3,390,614 | 7/1968 | Tatum | 318/620 |
| 3,440,504 | 4/1969 | Boskodich et al. | 318/565 |
| 3,552,872 | 1/1971 | Givas et al. | 290/40 |

*Primary Examiner*—Gene Z. Rubinson
*Assistant Examiner*—John W. Redman
*Attorney, Agent, or Firm*—E. F. Possessky

[57] ABSTRACT

A throttle valve test system for a large steam turbine functions in a turbine control system to provide throttle and governor valve test operations. The control system operates with a valve management capability to provide for pre-test governor valve mode transfer when desired, and it automatically generates feedforward valve position demand signals during and after valve tests to satisfy test and load control requirements and to provide smooth transition from valve test status to normal single or sequential governor valve operation. A digital computer is included in the control system to provide control and test functions in the generation of the valve position demand signals.

19 Claims, 21 Drawing Figures

11

STEAM TURBINE POWER PLANT HAVING IMPROVED TESTING METHOD AND SYSTEM FOR TURBINE INLET VALVES ASSOCIATED WITH DOWNSTREAM INLET VALVES PREFERABLY HAVING FEEDFORWARD POSITION MANAGED CONTROL

CROSS-REFERENCE TO RELATED APPLICATIONS

Ser. No. 247,877 entitled "System And Method For Starting, Synchronizing And Operating A Steam Turbine With Digital Computer Control", filed by T. C. Giras and R. Uram on Apr. 26, 1972 and assigned to the present assignee.

Ser. No. 306,752 entitled "System And Method Employing Valve Management For Operating A Steam Turbine", filed by T. C. Giras and L. Podolsky on Nov. 15, 1972 and assigned to the present assignee.

BACKGROUND OF THE INVENTION

In the operation of steam turbines in electric power plants, turbine load is determined by controlled flow of steam through steam admission valves. During startup, steam admission flow may be controlled by positioning control of the main high pressure turbine inlet valves. In fossil power plant turbines, the main high pressure turbine inlet valves comprise one or more throttle valves which are provided with a position control pilot valve. Just before or after synchronization, control of the steam admission flow is transferred from the throttle valves to the governor or control valves which are located downstream from the throttle valves in the high pressure turbine inlet flow configuration. Thereafter, the throttle valves are held wide open and turbine loading is controlled by the governor valves which are typically also provided with a position control capability.

In the case of nuclear power plants, the main high pressure turbine inlet valves are typically one or more stop valves instead of position controlled throttle valves. Accordingly, governor valves located downstream from the stop valves are typically position controlled throughout startup and loading operation to provide speed and load control for nuclear turbines.

Similarly, reheat steam flow between high pressure and intermediate pressure turbines passes through reheat stop valves and interceptor valves which can be position controlled. The reheat stop valves are normally open during turbine operation and they are closed only if a turbine trip condition occurs.

In turbine inlet valve configurations like those just described, steam inlet valve availability for turbine control is an important consideration in power plant management since power system security, plant scheduling and plant operating economy are all affected by this factor. Once the turbine is placed in load operation, changes effected in governor valve positions to meet load demand provide continuing checks of governor valve operability. Similarly, the interceptor valves are subject to periodic operation when supplied with position control to provide continuing checks on their operability.

In the case of turbine inlet valves which are held wide open during turbine load operation, no checks are normally made on valve availability as a result of valve operations directed to turbine speed and load control. For example, in the case of base load steam turbines, the period of uninterrupted load operation and inactive throttle valve or stop valve status can be several months or more. Accordingly, if at some unpredictable point in time it becomes necessary to close a throttle or stop valve to avoid turbine overspeed or for other plant purposes, there is relatively less assurance of throttle or stop valve availability as compared to governor or other valves which are position controlled during load operation.

Historically, tests have accordingly been employed for throttle and stop valves during turbine load operations in electric power plants. Typically, the turbine manufacturer recommends the frequency with which a valve test should be made, and that frequency for example could be once per week.

In performing the throttle or stop valve test, it is desirable that the test be performed without disturbing the power generation process regardless of whether the steam admission configuration is the single ended or double ended steam chest type, the Y-type, the in-line type or other types of commercially supplied steam admission valve configurations. Power should continue to be produced by the turbine driven generator even though the valve test is being performed, and no substantial change should occur in the power generation level during the initiation, performance and termination of the valve test. Accordingly, it is generally desirable that automatic load control be operative during valve tests to hold turbine steam and turbine load substantially constant. However, operator manual control can be used to adjust the turbine load as required during a valve test if an automatic load control is not available during the valve test.

Manufacturer recommendations typically specify maximum and minimum loads for performance of throttle or stop valve tests. The manufacturer specified upper load limit for valve testing is normally based on the load pickup capability of parallel inlet steam flow paths in the turbine undergoing throttle or stop inlet valve testing. Therefore, it would not be unusual that it would necessary to redistribute the load demand placed on the turbine before initiation of an inlet valve test so that the turbine load would be in the allowable range. Any cutback in turbine load demand would be made up by increasing the load demand on another turbine in the system.

There are other conditions or circumstances which should also be satisfied in the testing of turbine inlet valves. Thus, a test for valve availability should be performable whether the turbine is in the single or sequential mode of governor valve operation. In the sequential mode, the turbine stresses and shock produced by partial steam admission or operation can become excessive at lower load levels and it is principally this factor which serves as a basis for the manufacturer specified lower load limit for valve testing. Since nuclear turbines typically have only four arcs of steam admission with greater turbine stress and shock in partial arc operation, it would not be unusual for stop valve tests to be limited to single valve operation in nuclear turbines.

In one typical prior art valve test arrangement, each of two single ended steam chests supply turbine steam through four governor valves. A single throttle valve supplies steam to each chest from the plant steam source. An electrohydraulic controller positions the eight governor valves for load control as the two throttle valves are held wide open.

To test the throttle valve associated with one of the steam chests, it is necessary first to close the governor valves downstream from that throttle valve, then make a test closure of the throttle valve and reopen the throttle valve and finally reopen the associated governor valves. The same procedure is repeated for the second steam chest. Governor valve closure prior to throttle valve closure is necessary to avoid a high steam pressure drop across the test throttle valve when it is closed since throttle valves typically are not reopenable against high steam pressure. On the other hand governor valves typically can be reopened against high steam pressure since they typically operate with balanced valve plug forces.

Governor valve closure in the test procedure is typically effected in feedback analog turbine control systems by application of an electrical test bias signal to the electrohydraulic controllers for the governor valves to be closed. As the governor valves are closed, an impulse pressure control loop can automatically cause the remaining governor valves to open wider and meet load demand as the governor valves involved in the throttle valve test are closed. Alternatively, a manual control input can be used to raise the load demand signal artifically high so that the remaining governor valves more or less provide the load actually desired. Once the throttle valve test closure is completed, the test bias is removed from the associated governor valve controllers and turbine load operation is returned to normal. Thus, throttle valve testing can typically be performed with existing electrohydraulic feedback control systems substantially without disturbing existing load. Further, throttle valve testing can typically be initiated in either the sequential or the single valve mode of governor valve operation. Following a test, governor valves in the test path are reopened, and all governor valves smoothly move under feedback control to the positions required to satisfy load demand in the pretest governor valve mode.

In the prior art analog systems, tests for main inlet valve availability without turbine shutdown have been restricted by lower load limits in the sequential governor valve mode. Further, although main inlet valve testing has been generally smoothly implemented, no known provision has been made for implementing main inlet valve testing while operating the downstream valves with feedforward control nor with position management control nor particularly with feedforward position management control. By position managed control, it is meant to refer to a control capability which allows position changes to be made in parallel valves substantially without causing any change in the total steam flow.

Although the patent application Ser. No. 306,752 cross-referenced herein generally discloses a feedforward type digital electrohydraulic turbine control system in which transfers can be made on line between sequential and single valve modes of governor valve operation, that application similarly provides no direction on the testing of inlet stop or throttle valves without turbine shutdown at lower turbine load operating levels in the sequential mode. Nor is there any disclosure provided in that application on the manner in which inlet valve testing can be implemented in a feedforward type control system. The other cross-referenced application Ser. No. 247,877 and related applications cross-referenced therein disclose among other features a digital system for implementing main inlet valve testing specifically in an end bar lift type of inlet valve configuration.

In the present application, no representation is made that any cited prior patent or other art is the best prior art nor that the interpretation placed on such art herein is the only interpretation that can be placed on that art.

SUMMARY OF THE INVENTION

An electric power plant comprises a steam turbine having a plurality of turbine sections and having an inlet valve configuration including at least two main inlet valves and a plurality of position controllable valves downstream from each of the main inlet valves to supply steam to one of the turbine sections for driving a turbine rotor. A generator is driven by the turbine to produce electric power. Means are provided for operating the main inlet valves and for positioning the downstream valves preferably in a sequential valve mode or a single valve mode. Means are also preferably provided for transferring the downstream valves between sequential and single valve operating modes during turbine load operations substantially without disturbing the output of the generator.

The downstream valve positioning means preferably generates feedforward signals representative of the valve positions needed to satisfy a steam flow demand. The positioning means is employed to close and reopen the downstream valves associated with a main inlet valve to be tested as the remaining downstream valves are operated to satisfy steam flow demand. The main inlet valve to be tested is closed and reopened after closure and prior to reopening of the associated downstream valves. With the employment of feedforward valve position demand signals, the positioning means is updated to generate feedforward signals as the main inlet valve test is ended.

DESCRIPTION OF THE PREFERRED EMBODIMENT

Electric Power Plant and Steam Turbine System

Figure 1:
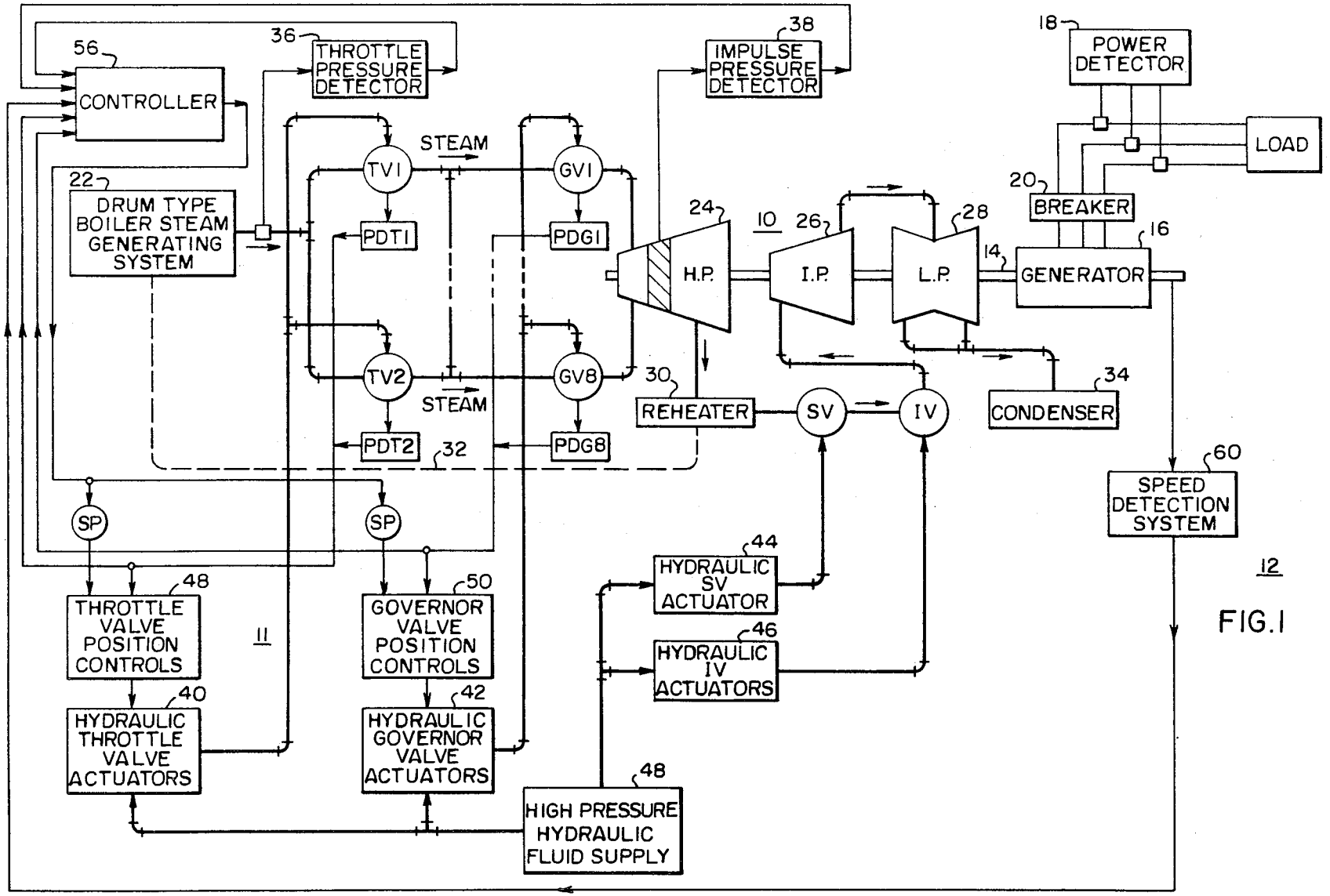
FIG. 1 shows a schematic diagram of an electric power plant arranged in accordance with the principles of the invention.

More specifically, there is shown in FIG. 1 a large single reheat steam turbine 10 constructed in a well known manner and operated by a control system 11 in a fossil electric power plant 12 in accordance with the principles of the invention. As will become more evident through this description, other types of steam turbines and electric power plants can also be operated in accordance with the principles of the invention. The turbine 10 and its control system 11 and the electric power plant 12 are like those disclosed in a copending patent application Ser. No. 247,877 entitled "System For Starting, Synchronizing and Operating a Steam Turbine With Digital Computer Control", filed by R. Uram on April 26, 1972 and assigned to the present assignee.

The turbine 10 is provided with a single output shaft 14 which drives a conventional large alternating current generator 16 to produce three-phase electric power sensed by a power detector 18. Typically, the generator 16 is connected through one or more breakers 20 per phase to a large electric power network and when so connected causes the turbo-generator arrangement to operate at synchronous speed under steady state conditions. Under transient electric load change conditions, system frequency may be affected and conforming turbo-generator speed changes would result.

After synchronism, power contribution of the generator 16 to the network is normally determined by the turbine steam flow which in this instance is supplied to the turbine 10 at substantially constant throttle pressure. The constant throttle pressure steam for driving the turbine 10 is developed by a steam generating system 22 which may for example be provided in the form of a conventional drum or once through type boiler operated by fossil fuel such as pulverized coal, natural gas or oil.

In this case, the turbine 10 is of the multistage axial flow type and it includes a high pressure section 24, an intermediate pressure section 26, and a low pressure section 28. Each of the turbine sections may include a plurality of expansion stages provided by stationary vanes and an interacting bladed rotor connected to the shaft 14.

The turbine 10 in this instance employs steam chests of the single ended type, and steam flow is directed to the turbine steam chests (not specifically indicated) through two main inlet valves or throttle inlet valves TV1 and TV2. Steam is directed from the admission steam chests to the first high pressure section expansion stage through eight governor inlet valves GV1–GV8 which are arranged to supply steam to inlets arcuately spaced about the turbine high pressure casing to constitute a somewhat typical governor valve arrangement for large fossil fuel turbines. Nuclear turbines on the other hand typically utilize only four governor valves. Generally, various turbine inlet valve configurations can involve different numbers and/or arrangements of inlet valves.

In applications where the throttle valves have a flow control capability, the governor valves GV1–GV8 are typically all fully open during all or part of the startup process and steam flow is then varied by full arc throttle valve control. At some point in the startup and loading process, transfer is normally and preferably automatically made from full arc throttle valve control to full arc governor valve control because of throttling energy losses and/or reduced throttling control capability. Upon transfer, the throttle valves TV1 and TV2 are fully open, and the governor valves GV1–GV8 are positioned to produce the steam flow existing at transfer. After sufficient turbine heating has occurred, the operator would typically transfer from full arc governor valve control to partial arc governor valve control to obtain improved heating rates.

In the partial arc mode, the governor valves are operated in a predetermined sequence usually directed to achieving thermal balance on the rotor and relatively reduced rotor blade stressing while producing the desired turbine speed and/or load operating level. For example, in a typical governor valve control mode, governor valves GV5–GV8 may be initially closed as the governor valves GV1–GV4 are jointly operated from time to time to defined positions producing the desired total steam flow. After the governor valves GV1–GV4 have reached the end of their control region, i.e. upon being fully open or at some overlap point prior to reaching fully open positions, the governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing.

If the main steam inlet valves are stop valves without flow control capability as is often the case in nuclear turbines, initial steam flow control is achieved during startup by means of a single valve mode of governor valve operation. Transfer can then be made to sequential governor valve operation at an appropriate load level.

In the described arrangement with throttle valve control capability, the preferred turbine startup and loading method is to raise the turbine speed from the turning gear speed of about 2 rpm to about 80% of the synchronous speed under throttle valve control, then transfer to full arc governor valve control and raise the turbine speed to the synchronous speed, then close the power system breakers and meet the load demand with full or partial arc governor valve control. On shutdown, governor valve control or coastdown may be employed. Other throttle/governor valve transfer practice may be employed but it is unlikely that transfer would be made at a loading point above 40% rated load because of throttling efficiency considerations.

Similarly, the conditions for transfer between full arc and partial arc governor valve control modes can vary in other applications of the invention. For example, on a hot start it may be desirable to transfer from throttle valve control directly to partial arc governor valve control at about 80% synchronous speed.

After the steam has crossed past the first stage impulse blading to the first stage reaction blading of the high pressure section, it is directed to a reheater system 30 which is associated in heat transfer relation with the steam generating system 22 as indicated by the reference character 32. With a raised enthalpy level, the reheated steam flows from the reheater system 30 through the intermediate pressure turbine section 26 and the low pressure turbine section 28. From the latter, the vitiated steam is exhausted to a condenser 34 from which water flow is directed (not indicated) back to the steam generating system 26.

To control the flow of reheat steam, one or more reheat stop valves SV are normally open and closed only when the turbine is tripped. Interceptor valves IV (only one indicated), are also provided in the reheat steam flow path.

In the typical fossil fuel drum type boiler steam generating system, the boiler control system operates the boiler so that steam throttle pressure is controlled to be substantially constant or within a predetermined range of values. A throttle pressure detector 36 of suitable conventional design senses the steam throttle pressure for data monitoring and/or turbine or plant control purposes. If desired in nuclear or other plant applications, turbine control action can be directed to throttle pressure control as well as or in place of speed and/or load control.

In general, the steady state power or load developed by a steam turbine supplied with substantially constant throttle pressure steam is proportional to the ratio of first stage impulse pressure to throttle pressure. Where the throttle pressure is held substantially constant by external control, the turbine load is proportional to the first stage impulse pressure. A conventional pressure detector 38 is employed to sense the first stage impulse pressure for assigned control usage in the turbine control 11.

A speed detection system 60 is provided for determining the turbine shaft speed for speed control and for frequency participation control purposes. The speed detector 60 can for example include a reluctance pickup (not shown) magnetically coupled to a notched wheel (not shown) on the turbo-generator shaft 14. In the present case, a plurality of sensors are employed for speed detection.

Respective hydraulically operated throttle valve actuators 40 and governor valve actuators 42 are provided for the four throttle valves TV1–TV4 and the eight governor valves GV1–GV8. Hydraulically operated actuators 44 and 46 are also provided for the reheat stop and interceptor valves SV and IV. A high pressure hydraulic fluid supply 48 provides the controlling fluid for actuator operation of the valves TV1–TV4, GV1–GV8, SV and IV. A lubricating oil system (not shown) is separately provided for turbine plant lubricating requirements.

The inlet valve actuators 40 and 42 are operated by respective electrohydraulic position controls 48 and 50 which form a part of the control system 11. If desired, the interceptor valve actuators 46 can also be operated by a position control (now shown).

Figure 2:
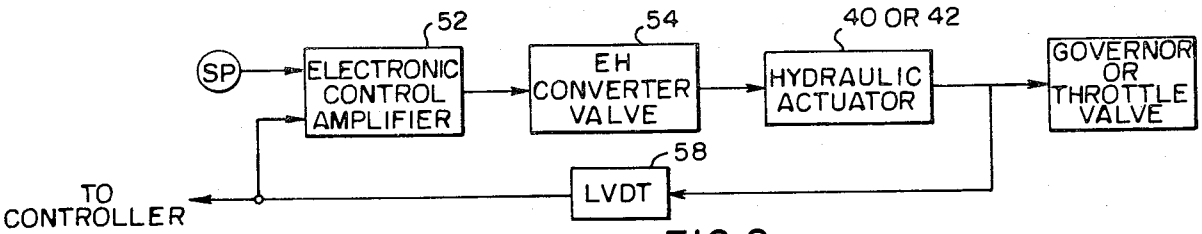
FIG. 2 shows a schematic diagram of an electrohydraulic position control loop employed for operating turbine governor and throttle valves associated with the plant of FIG. 1.

Each position control includes a conventional electronic control amplifier 52 (FIG. 2) which drives a Moog valve 54 or other suitable electrohydraulic (EH) converter valve in the well known manner. Since the turbine power is proportional to steam flow under substantially constant throttle pressure, inlet valve positions are controlled to produce control over steam flow as an intermediate variable and over turbine speed and/or load as an end control variable or variables. The actuators position the steam valves in response to output position control signals applied through the EH converters 54. Respective valve position detectors PDT1–PDT4 and PDG1–PDG8 are provided to generate respective valve position feedback signals which are combined with respective valve position setpoint signals SP to provide position error signals from which the control amplifiers 52 generate the output control signals.

The setpoint signals SP are generated by a controller 56 which also forms a part of the control system 11. The position detectors are provided in suitable conventional form, for example they may be linear variable differential transformers 58 (FIG. 2) which generate negative position feedback signals for algebraic summing with the valve position setpoint signals SP.

The combination of the amplifier 52, converter 54, hydraulic actuator 40 or 42, and the associated valve position detector 58 and other miscellaneous devices (not shown) form a local analog electrohydraulic valve position control loop 62 for each throttle or governor inlet steam valve. In the present case, the local analog electrohydraulic valve position control loop is preferably included in the control system 11 even where the controller 56 includes a programmed digital computer because of the combined effects of control computer operating speed capabilities and computer hardware economics, i.e. the cost of a manual backup analog control, which is readily interfaced with the local analog valve position loops, is less than that for a backup digital computer control at present control computer operating speeds for particular applications so far developed.

Steam Turbine Control Loops

Figure 3:
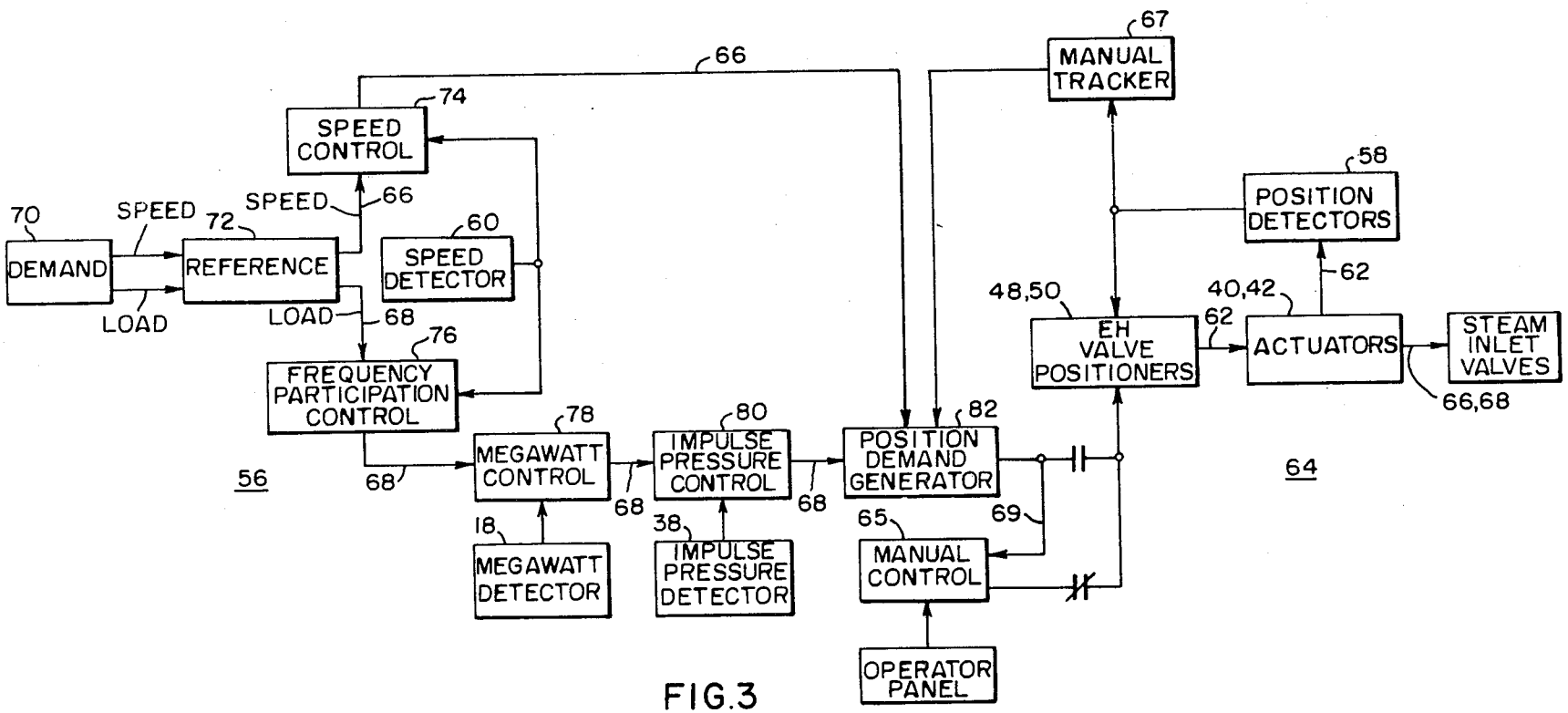
FIG. 3 shows a schematic control loop diagram which represents the functioning of a control system associated with the power plant of FIG. 1.

In FIG. 3, there is shown the preferred arrangement 64 of control loops employed in the control system 11 to provide automatic and manual turbine operation. To provide for power generation continuity and security, a manual backup control 65 is shown for implementing operator control actions during time periods when the automatic control is shut down. Relay contacts effect automatic or manual control operation as illustrated. Bumpless transfer is preferably provided between the manual and automatic operating modes, and for this purpose a manual tracker 67 is employed for the purpose of updating the automatic control on the status of the manual control 65 during manual control operation and the manual control 65 is updated on the status of the automatic control during automatic control operation as indicated by the reference character 69.

The control loop arrangement 62 is schematically represented by functional blocks, and varying structure can be employed to produce the block functions. In addition, various block functions can be omitted, modified or added in the control loop arrangement 62 consistently with application of the present invention. It is further noted that the arrangement 62 functions within overriding restrictions imposed by elements of an overall turbine and plant protection system (not specifically indicated in FIG. 3).

During startup, an automatic speed control loop 66 in the control loop arrangement 62 operates the turbine inlet valves to place the turbine 10 under wide range speed control and bring it to synchronous speed for automatic or operator controlled synchronization. After synchronization, an automatic load control loop 68 operates the turbine inlet valves to load the turbine 10. The speed and load control loops 66 and 68 function through the previously noted EH valve position control loops 62.

The controller 56 of FIG. 1 is included in the control loops, and it includes a demand block 70. Speed and load demands are generated by the block 70 for the speed and load control loops 64 and 66 under varying operating conditions in response to a remote automatic load dispatch input, a synchronization speed requirement, a load or speed input generated by the turbine operator or other predetermined controlling inputs. A reference generator block 72 responds to the speed or load demand to generate a speed or load reference during turbine startup and load operation preferably so that speed and loading change rates are limited to avoid excessive thermal stress on the turbine parts.

An automatic turbine startup control can be included as part of the demand and reference blocks 68 and 70 and when so included it causes the turbine inlet steam flow to change to meet speed and/or load change requirements with rotor stress control. In that manner, turbine life can be strategically extended.

The speed control loop 66 preferably functions as a feedback type loop, and the speed reference is accordingly compared to a representation of the turbine speed derived from the speed detector 60. A speed control 74 responds to the resultant speed error to generate a steam flow demand from which a setpoint is developed for use in developing valve position demands for the EH valve position control loops 62 during speed control operation.

The load control loop 68 preferably includes a frequency participation control subloop, a megawatt control subloop and an impulse pressure control subloop which are all cascaded together to develop a steam flow demand from which a setpoint is derived for the EH valve position control loops 62 during load control operation. The various subloops are preferably designed to stabilize interactions among the major turbine-generator variables, i.e. impulse pressure, megawatts, speed and valve position. Preferably, the individual load control subloops are arranged so that they can be bumplessly switched into and out of operation in the load control loop 68.

The load reference and the speed detector output are compared by a frequency participation control 76, and preferably it includes a proportional controller which operates on the comparison result to produce an output which is summed with the load reference. A frequency compensated load reference is accordingly generated to produce a megawatt demand.

A megawatt control 78 responds to the megawatt demand and a megawatt signal from the detector 18 to generate an impulse pressure demand. In the megawatt control subloop, the megawatt error is determined from the megawatt feedback signal and the megawatt demand, and it is operated upon by a proportional plus integral controller which produces a megawatt trim signal for multiplication against the megawatt demand.

In turn, an impulse pressure control 80 responds to an impulse pressure signal from the detector 38 and the impulse pressure demand from the megawatt control to generate a steam flow demand from which the valve position demands are generated for forward application to the EH valve position control loops 62. Preferably, the impulse pressure control subloop is the feedback type with the impulse pressure error being applied to a proportional plus integral controller which generates the steam flow demand.

Generally, the application of feedforward and feedback principles in the control loops and the types of control transfer functions employed in the loops can vary from application to application. More detail on the described control loops is presented in a copending application Ser. No. 247,877, entitled "System And Method For Starting, Synchronizing And Operating A Steam Turbine With Digital Computer Control", filed by T. C. Giras and R. Uram on Apr. 26, 1972 and assigned to the present assignee, as well as other copending applications cross-referenced therein.

Speed loop or load flow demand is applied to a position demand generator 82 which generates feedforward valve position demands for application to the EH valve position controls 52, 54 in the EH valve position control loops 62. Generally, the position demand generator 82 employs an appropriate characterization to generate throttle and governor valve position demands as required for implementing the existing control mode as turbine speed and load requirements are satisfied. Thus, up to 80% synchronous speed, the governor valves are held wide open as the throttle valves are positioned to achieve speed control. After transfer, the throttle valves are held wide open and the governor valves are positioned either in single valve operation or sequential valve operation to achieve speed and/or load control. The position demand generator 82 can also include a valve management function as set forth more fully in a copending patent application Ser. No. 306,752 entitled "System And Method Employing Valve Management For Operating A Steam Turbine", filed by T. C. Giras and L. B. Podolsky on Nov. 15, 1972 and assigned to the present assignee and related copending applications cross-referenced therein.

Control System

Figure 4:
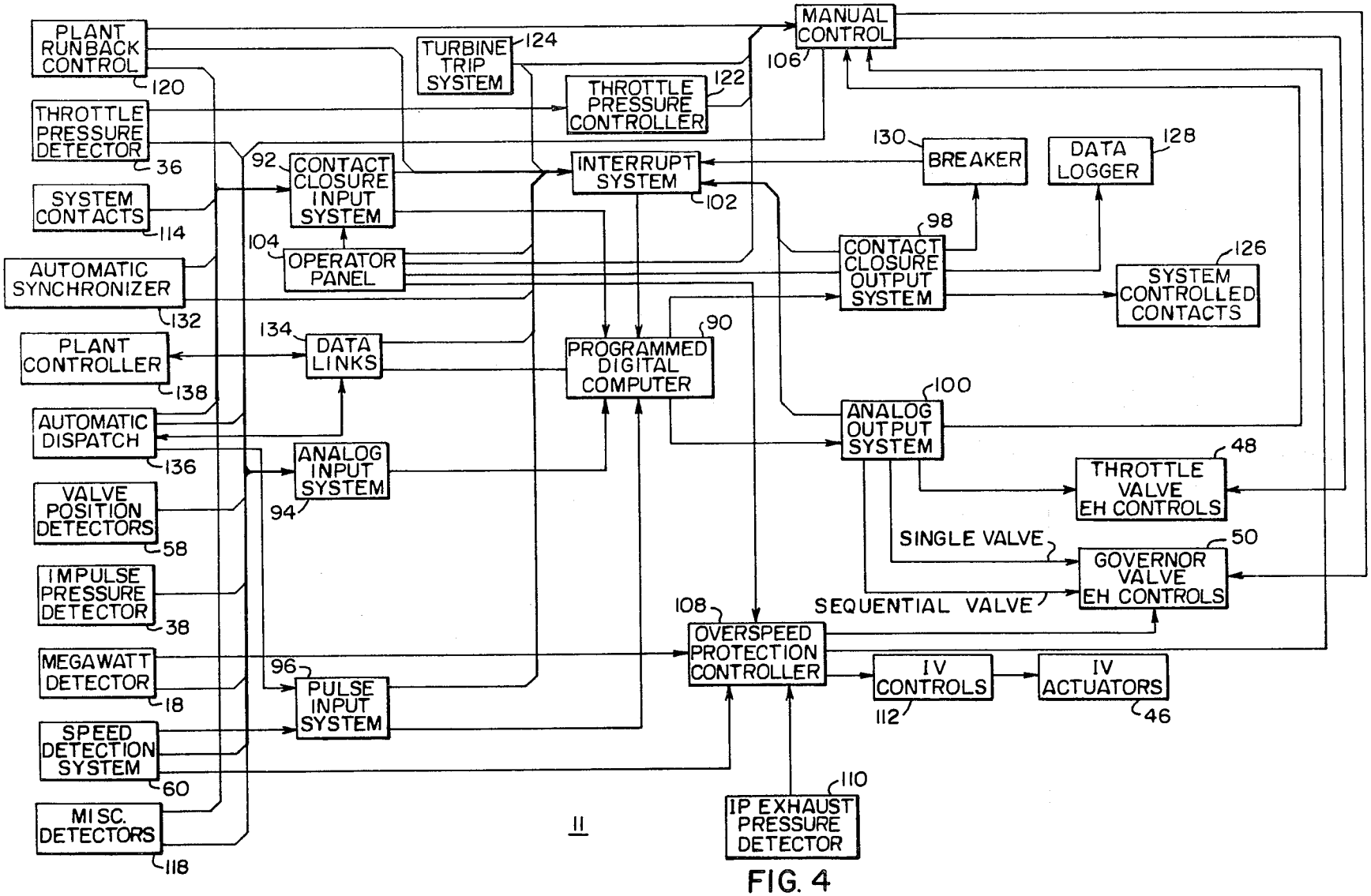
FIG. 4 shows a structural block diagram of the control system in its preferred form.

In its preferred form, the control system 11 includes a programmed digital computer 90 and associated input-/output equipment as shown in the block diagram of FIG. 4 where each individual block generally corresponds to a particular structural unit of the control system 11. In relating FIG. 3 with FIG. 4, it is noted that particular functional blocks of FIG. 3 may be embraced by one or more structural blocks of FIG. 4. The computer 90 in this case is a P2000 computer sold by Westinghouse Electric Corporation and designed for real time process control applications, and it operates with a 16-bit word length, 2's complement, and single address in a parallel mode. A 3 microsecond memory cycle time is employed in the P2000 computer and all basic control functions can be performed with a 16K core. Expansion can be made to a 65K core to handle various options includable in particular control systems.

A conventional contact closure input system 92 and analog input system 94 are coupled to the computer 90 to interface system analog and contact signals with the computer at its input. A pulse input system 96 similarly interfaces pulse type system signals with the computer at its input. Computer output signals are interfaced with external controlled devices through a suitable contact closure output system 98 and a suitable analog output system 100.

A conventional interrupt system 102 is employed to signal the computer 90 when a computer input is to be executed or when a computer output has been executed. The computer 90 operates immediately to detect the identity of the interrupt and to execute or to schedule execution of the response required for the interrupt.

An operator panel 104 provides for operator control, monitoring, testing and maintenance of the turbine-generator system. Panel signals are applied to the computer 90 through the contact closure input system 92 and computer display outputs are applied to the panel 104 through the contact closure output system 98. During manual control, panel signals are applied to a manual backup control 106 which is like the manual control 65 of FIG. 2 but is specifically arranged for use with the digital computer 90. More detail on a suitable manual backup control arrangement is set forth in U.S. Pat. No 3,552,872 issued to T. Giras et al and a copending application Ser. No. 080,710 entitled "Steam Turbine System With Digital Computer Position Control Having Improved Automatic Manual Interaction" filed by A. Braytenbah on Oct. 14, 1970 and assigned to the present assignee.

An overspeed protection controller 108 provides protection for the turbine 10 by closing the governor valves and the interceptor valves under partial or full load loss and overspeed conditions, and the panel 104 is tied to the overspeed protection controller 108 to provide an operating setpoint therefor. The power or megawatt detector 18, the speed detector 60 and an exhaust pressure detector 110 associated with the IP turbine section generate signals which are applied to the controller 108 in providing overspeed protection. More detail on a suitable overspeed protection scheme is set forth in U.S. Pat. No. 3,643,437, issued to M. Birnbaum et al.

Input signals are applied to the computer 90 from various relay contacts 114 in the turbine-generator system through the contact closure input system 92. In addition, signals from the electric power, steam pressure and speed detectors 18, 36, 38 and 60 and steam valve position detectors 50 and other miscellaneous detectors 118 are interfaced with the computer 90. The detectors 118 for example can include impulse chamber and other temperature detectors, vibration sensors, differential expansion sensors, lubricant and coolant pressure sensors, and current and voltage sensors.

Generally, the control loops described in connection with FIG. 3 are embodied in FIG. 4 by incorporation of the computer 90 as a control element in those loops. The manual backup control 106 and its control loop are of course external to the computer 90.

In addition, certain other control loops function principally as part of a protection system externally of the computer 90 or both externally and internally of the computer 90. Thus, the overspeed protection controller 108 functions in a loop external to the computer 90, and a plant runback control 120 functions in a control loop through the computer 90 as well as a control loop external to the computer 90 through the manual control 106. A throttle pressure control 122 functions through the manual control 106 in a control loop outside the computer, and throttle pressure is also applied to the computer 90 for monitoring and control purposes. A turbine trip system 124 causes the manual control and computer control outputs to reflect a trip action initiated by independent mechanical or other trips in the overall turbine protection system.

Contact closure outputs from the computer 90 operate various system contacts 126, a data logger 128 such as an electric typewriter, and various displays, lights and other devices associated with the operator panel 104. Further, in a plant synchronizing system, a breaker 130 is operated by the computer 90 through computer output contacts. If desired, synchronization can be performed automatically during startup with the use of an external synchronizer 132, it can be accurately performed manually with the use of the accurate digital speed control loop which operates through the computer 90, or it can be performed by use of an analog/digital hybrid synchronization system which employs a digital computer in the manner set forth in a copending application Ser. No. 276,508, entitled "System And Method Employing A Digital Computer For Automatically Synchronizing A Gas Turbine Or Other Electric Power Plant Generator With A Power System" filed by J. Reuther on July 31, 1972 as a continuation of an earlier filed patent application and assigned to the present assignee.

The analog output system 100 applies valve position signals to the throttle and governor valve controls during automatic control. Further, the automatic valve position signals are applied to the manual control 106 for bumpless automatic-manual transfer purposes. In manual operation, the manual control 106 generates the position signals for application to the throttle and governor valve controls and for application to the computer 90 for computer tracking needed for bumpless manual-automatic transfer.

Data links 134 interface the turbine computer 10 with an automatic dispatch computer or other controller 136 for system load scheduling and dispatch operations. The data links 134 also provide a tie with a plant digital computer or other controller 138 for integrated plant control purposes, i.e. for suitable coordination of the control of the plant steam generator source 22 and the turbine-generator unit 10, 16.

More detail on a control system like that shown in FIG. 4 is set forth in the aforementioned copending Uram patent application Ser. No. 247,877 and other copending applications cross-referenced therein.

Program System For Control Computer

Figure 5:
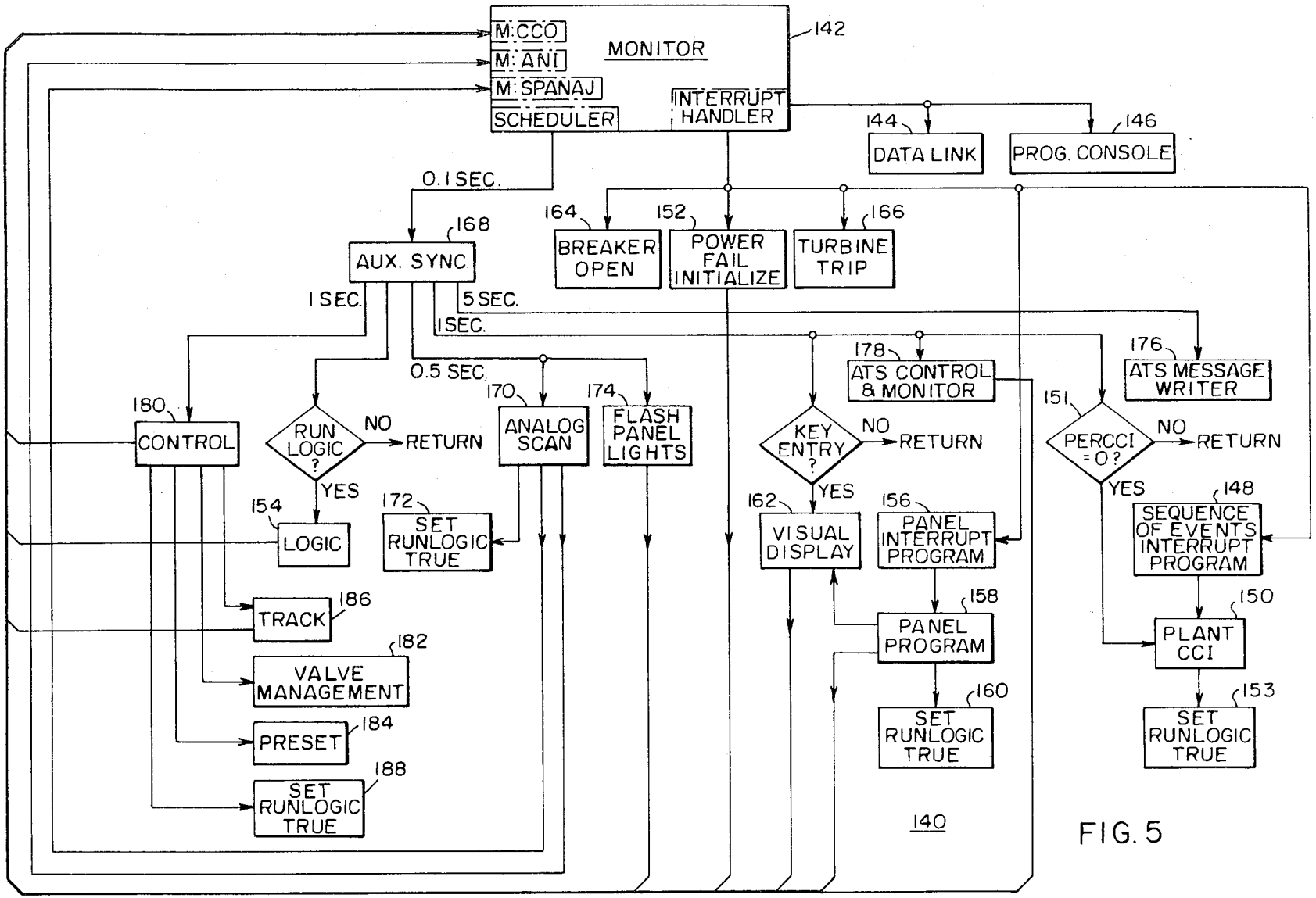
FIG. 5 shows a schematic organization chart for a program system employed in a digital computer which functions as a part of the control system.

A computer program system 140 is preferably organized as shown in FIG. 5 to operate the control system 11 as a sampled data system in providing turbine and plant monitoring and continuous turbine and plant control with stability, accuracy and substantially optimum response. The program system 140 will be described herein only to the extent necessary to develop an understanding of the manner in which the present invention is applied. A program system similar to the program system 140 is disclosed in greater detail in the aforementioned Uram patent application Ser. No. 247,877.

A standard executive or monitor program 142 provides scheduling control over the running of programs in the computer 90 as well as control over the flow of computer inputs and outputs through the previously described input/output systems. Generally, each program is assigned to a task level in a priority system, and bids are processed to run the bidding program with the highest priority. Interrupts may bid programs, and all interrupts are processed with a priority higher than any task level.

A data link program 144 is bid on interrupt demand to provide for intercomputer data flow. A programmer's console program 146 is also bid on demand by interrupt and it enables an operator to make parameter and other program system changes.

When a system contact changes state, an interrupt causes a sequence of events interrupt program 148 to place a bid for a scan of all system or plant contacts by a program 150. A periodic bid can also be placed for running the contact closure input program 150 through a block 151. A power fail initialize 152 also can bid the contact closure input program 150 to run as part of the computer initialization procedure during computer starting or restarting. The program 152 also initializes contact outputs through the executive 142. In some instances, changes in contact inputs will cause a bid 153 to be placed for a logic task program 154 to be executed so as to achieve programmed responses to certain contact input changes.

When an operator panel signal is generated, external circuitry decodes the panel input and an interrupt is generated to cause a panel interrupt program 156 to place a bid for the execution of a panel program 158 which provides a response to the panel request. The panel program 158 can itself carry out the necessary response or it can place a bid 160 for the logic task program 154 to perform the response or it can bid a visual display program 162 to carry out the response. In turn, the visual display program 162 operates contact closure outputs to produce the responsive panel display.

Generally, the visual display program 162 causes numerical data to be displayed in panel windows in accordance with operator request. When the operator requests a new display quantity, the visual display program 162 is initially bid by the panel program 158. Apart from a new display request, the visual display program 162 is bid periodically to display the existing list of quantities requested for display.

The pushbuttons and keys on the operator panel 104 are classifiable in one of several functional groups. Some pushbuttons are classified as control system switching since they provide for switching in or out certain control functions. Another group of pushbuttons provide for operating mode selection. A third group of pushbuttons provide for automatic turbine startup and a fourth group provide for manual turbine operation. Another group of pushbuttons are related to valve status/testing/limiting, while a sixth group provide for visual display and change of DEH system parameters. The final group of pushbuttons relate to keyboard activity, i.e. of the entry of numerical data into the computer 90.

A breaker open interrupt program 164 causes the computer 90 to generate a close governor valve bias signal when load is dropped. Similarly, when the trip system 124 trips the turbine 10, a trip interrupt program 166 causes close throttle and governor valve bias signals to be generated by the computer 90. After the governor valves have been closed in response to a breaker open interrupt, the system reverts to speed control and the governor valves are positioned to maintain synchronous speed.

Periodic programs are scheduled by an auxiliary synchronizer program 168 which in turn is bid each tenth of a second by the executive 142. An external clock (not shown) functions as the system timing source. An analog scan program 170 is bid every half second to select analog inputs for updating through an executive analog input handler. After scanning, the analog scan program 170 converts the inputs to engineering units, performs limit checks and makes certain logical decisions. The logic task 154 may be bid by block 172 as a result of an analog scan program run.

A flash panel lights program 174 is also bid every half second to flash predetermined panel lights through the executive contact closure output handler under certain conditions. In the present embodiment, a total of nine conditions are continually monitored for flashing.

The logic program 154 is run periodically to perform various logic tasks if it has been bid. An automatic turbine startup message writer program 176 is run every 5 seconds to provide a printout of significant startup events.

The software control functions are principally embodied in a periodically run automatic turbine startup (ATS) control and monitoring program 178 and a periodically run control program 180, with certain supportive program functions being performed by the logic task 154 or certain subroutines. To provide rotor stress control on turbine acceleration or turbine loading rate in the startup speed control loop 66 or the load control loop 68, rotor stress is calculated by the ATS program 178 on the basis of detected turbine impulse chamber temperature and other parameters.

The ATS program 178 also supervises turning gear operation, eccentricity, vibration, turbine metal and bearing temperatures, exciter and generator parameters, gland seal and turbine exhaust conditions, condenser vacuum, drain valve operation, anticipated steam chest wall temperature, bolt flange differential, and end differential expansion. Appropriate control actions are initiated under programmed conditions detected by the functioning of the monitor system.

Among other functions, the ATS program 178 also sequences the turbine through the various stages of startup operation from turning gear to synchronization. More detail on the ATS program 178 is disclosed in another copending application Ser. No. 247,598 entitled System And Method For Operating A Steam Turbine With Digital Computer Control Having Automatic Startup Sequential Programming, filed by J. Tanco on Apr. 26, 1972 and assigned to the present assignee.

In the control program 180, program functions generally are directed to (1) computing throttle and governor valve positions to satisfy speed and/or load demand during operator or remote automatic operation and (2) tracking valve position during manual operation. Generally, the control program 180 is organized as a series of relatively short subprograms which are sequentially executed.

In performing turbine control, speed data selection from multiple independent sources is utilized for operating reliability, and operator entered program limits are placed on high and low load, valve position and throttle pressure. Generally, the control program 180 executes operator or automatically initiated transfers bumplessly between manual and automatic modes and bumplessly between one automatic mode and another automatic mode. In the execution of control and monitor functions, the control program 180 and the ATS program 178 are supplied as required with appropriate representations of data derived from input detectors and system contacts described in connection with FIG. 4. Generally, predetermined valve tests can be performed online compatibly with control of the turbine operation through the control programming.

The control program 180 logically determines turbine operating mode by a select operating mode function which operates in response to logic states detected by the logic program 154 from panel and contact closure inputs. For each mode, appropriate values for demand and rate of change of demand are defined for use in control program execution of speed and/or load control.

The following speed control modes are available when the breaker is open in the heirarchical order listed: (1) Automatic Synchronizer in which pulse type contact inputs provide incremental adjustment of the turbine speed reference and demand; (2) Automatic Turbine Startup which automatically generates the turbine speed demand and rate; (3) Operator Automatic in which the operator generates the speed demand and rate; (4) Maintenance Test in which the operator enters speed demand and rate while the control system is being operated as a simulator/trainer; (5) Manual Tracking in which the speed demand and rate are internally computed to track the manual control preparatory to bumpless transfer from manual to automatic operation.

The following load control modes are available when the breaker is closed in the heirarchical order listed: (1) Throttle Pressure Limiting in which the turbine load reference is run back at a predetermined rate to a preset minimum as long as the limiting condition exists; (2) Runback in which the load reference is run back at a predetermined rate as long as predefined contingency conditions exist; (3) Automatic Dispatch System in which pulse type contact inputs provide for adjusting the turbine load reference and demand; (4) Automatic Turbine Loading (if included in system) in which the turbine load demand and rate are automatically generated; (5) Operator Automatic in which the operator generates load demand and rate; (6) Maintenance Test in which the operator enters load demand and rate while the control system is being operated as a simulator/trainer; (7) Manual Tracking in which the load demand and rate are internally computed to track the manual control preparatory to bumpless transfer to automatic control.

In executing turbine control within the control loops described in connection with FIG. 3, the control program 180 includes a speed/load reference function. Once the operating mode is defined, the speed/load reference function generates the reference which is used by the applicable control functions in generating valve position demand.

The speed or load reference is generated at a controlled or selected rate to meet the defined demand. Generation of the reference at a controlled rate until it reaches the demand is especially significant in the automatic modes of operation. In modes such as the Automatic Synchronizer or Automatic Dispatch System, the reference is advanced in pulses which are carried out in single steps and the speed/load reference function is essentially inactive in these modes. Generally, the speed/load reference function is responsive to GO and HOLD logic and in the GO condition the reference is run up or down at the program defined rate until it equals the demand or until a limit condition or synchronizer or dispatch requirement is met.

A speed control function provides for operating the throttle and governor valves to drive the turbine 10 to the speed corresponding to the reference with substantially optimum dynamic and steady-state response. The speed error is applied to either a software proportional-plus-reset throttle valve controller or a software proportional-plus-reset governor valve controller.

Similarly, a load control function provides for positioning the governor valves so as to satisfy the existing load reference with substantially optimum dynamic and steady-state response. The load reference value computed by the operating mode selection function is compensated for frequency participation by a proportional feedback trim factor and for megawatt error by a second feedback trim factor. A software proportional-plus-reset controller is employed in the megawatt feedback trim loop to reduce megawatt error to zero.

The frequency and megawatt corrected load reference operates as a setpoint for the impulse pressure control or as a flow demand for a valve management subroutine 182 (FIG. 5) according to whether the impulse pressure control is in or out of service. In the impulse pressure control, a software proportional-plus-reset controller is employed to drive the impulse pressure error to zero. The output of the impulse pressure controller or the output of the speed and megawatt corrected load reference functions as a governor valve setpoint which is converted into a percent flow demand prior to application to the valve management subroutine 182.

The control program 180 further includes a throttle valve control function and a governor valve control function. During automatic control, the outputs from the throttle valve control function are position demands for the throttle valves, and during manual control the throttle valve control outputs are tracked to the like outputs from the manual control 106. Generally, the position demands hold the throttle valves closed during a turbine trip, provide for throttle valve position control during startup and during transfer to governor valve control, and drive and hold the throttle valves wide open during and after the completion of the throttle/-governor valve transfer.

The governor valve control function generally operates in a manner similar to that described for the throttle valve control function during automatic and manual operations of the control system 11. If the valve management subroutine 182 is employed, the governor valve control function outputs data applied to it by the valve management subroutine 182.

If the valve management subroutine 182 is not employed, the governor valve control function employs a nonlinear characterization function to compensate for the nonlinear flow versus lift characteristics of the governor valves. The output from the nonlinear characterization function represents governor valve position demand which is based on the input flow demand. A valve position limit entered by the operator may place a restriction on the governor valve position demand prior to output from the computer 90.

Generally, the governor valve control function provides for holding the governor valves closed during a turbine trip, holding the governor valves wide open during startup and under throttle valve control, driving the governor valves closed during transfer from throttle to governor valve operation during startup, reopening the governor valves under position control after brief closure during throttle/governor valve transfer and thereafter during subsequent startup and load control.

A preset subroutine 184 evaluates an algorithm for a proportional-plus-reset controller as required during execution of the control program 180. In addition, a track subroutine 186 is employed when the control system 11 is in the manual mode of operation.

Certain logic operations are performed by the logic program 154 in response to a control program bid by block 188. The logic program 154 includes a series of control and other logic tasks which are related to various parts of the program system 140 and it is executed when a bid occurs on demand from the auxiliary synchronizer program 168 in response to a bid from other programs in the system.

Generally, the purpose of the logic program 154 is to define the operational status of the control system 11 from information obtained from the turbine system, the operator and other programs in the program system 140. Logic tasks included in the program 154 include the following: flip-flop function; maintenance task; speed channel failure monitor lamps; automatic computer to manual transfer logic; operator automatic logic; GO and HOLD logic; governor control and throttle control logic; turbine latch and breaker logic; megawatt feedback, impulse pressure, and speed feedback logic; and automatic synchronizer and dispatch logic.

During automatic computer control, the valve management subroutine 182 develops the governor valve position demands needed to satisfy steam flow demand and ultimately the speed/load reference and to do so in either the sequential or the single valve mode of governor valve operation or during transfer between these modes. Mode transfer is effected bumplessly with no load change other than any which might be demanded during transfer. Since changes in throttle pressure cause actual steam flow changes at any given turbine inlet valve position, the governor valve position demands may be corrected as a function of throttle pressure variation. In the manual mode, the track subroutine 186 employs the valve management subroutine 182 to provide governor valve position demand calculations for bumpless manual-automatic transfer.

Governor valve position is calculated from a linearizing characterization in the form of a curve of valve position (or lift) versus steam flow. A curve valid for low-load operation is stored for use by the valve management program 182 and the curve employed for control calculations is obtained by correcting the stored curve for changes in load or flow demand and preferably for changes in actual throttle pressure. Another stored curve of flow coefficient versus steam flow demand is used to determine the applicable flow coefficient to be used in correcting the stored low-load position demand curve for load or flow changes. Preferably, the valve position demand curve is also corrected for the number of nozzles downstream from each governor valve.

In the single valve mode, the calculated total governor valve position demand is divided by the total number of governor valves to generate the position demand per valve which is output as a single valve analog voltage (FIG. 4) applied commonly to all governor valves. In the sequential mode, the governor valve sequence is used in determining from the corrected position demand curve which governor valve or group of governor valves is fully open and which governor valve or group of governor valves is to be placed under position control to meet load references changes. Position demands are determined for the individual governor valves, and individual sequential valve analog voltages (FIG. 4) are generated to correspond to the calculated valve position demands. The single valve voltage is held at zero during sequential valve operation and the sequential valve voltage is held at zero during single valve operation.

To transfer from single to sequential valve operation, the net position demand signal applied to each governor valve EH control is held constant as the single valve analog voltage is stepped to zero and the sequential valve analog voltage is stepped to the single valve voltage value. Sequential valve position demands are then computed and the steam flow changes required to reach target steam flows through individual governor valves are determined. Steam flow changes are then implemented iteratively, with the number of iterations determined by dividing the maximum flow change for any one governor valve by a predetermined maximum flow change per iteration. Total steam flow remains substantially constant during transfer since the sum of incremental steam flow changes is zero for any one iteration.

To transfer from sequential to single valve operation, the single valve position demand is determined from steam flow demand. Flow changes required to satisfy the target steam flow are determined for each governor valve, and an iteration procedure like that described for single-to-sequential transfer is employed in incrementing the valve positions to achieve the single valve target position substantially without disturbing total steam flow. If steam flow demand changes during any transfer, the transfer is suspended as the steam flow change is satisfied equally by all valves movable in the direction required to meet the change.

Turbine Inlet Valve Configurations

Figure 6A:
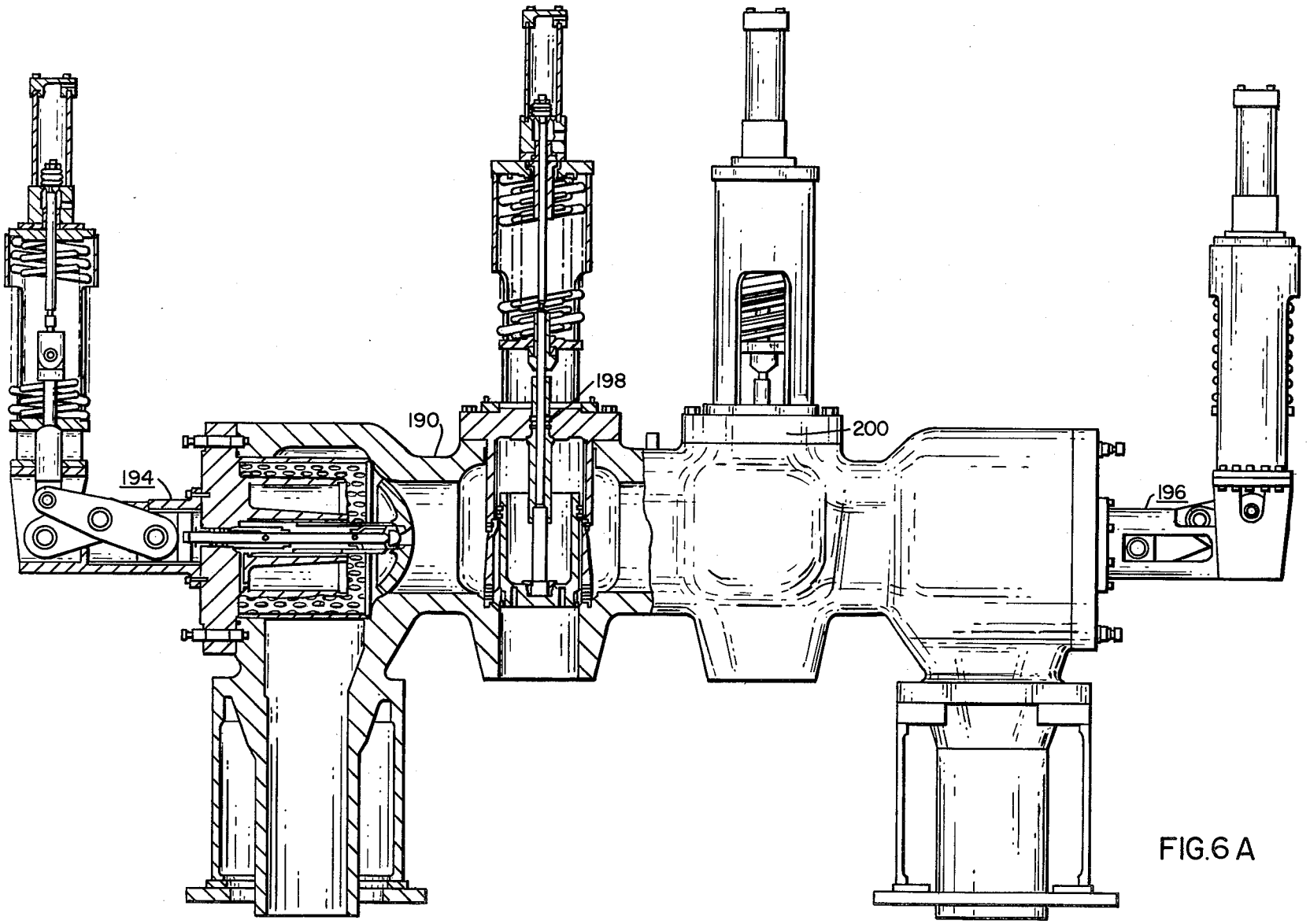
FIG. 6A shows a partially sectioned longitudinal view of a double ended steam chest with its associated throttle and governor valves.

In order to illustrate the application of the invention, there are shown in FIGS. 6A–6I various typical turbine inlet valve configurations. In FIG. 6A, there is shown a double ended steam chest 190 for a high pressure turbine section. The steam chest 190 is known as the BB 296 arrangement and it is sold as part of nuclear turbines by Westinghouse Electric Corporation. A pair of steam chests 190 would commonly be used in parallel to supply turbine steam as shown by an arrangement 192 in FIG. 6B.

The steam chest 190 has a pair of inlet throttle valves 194 and 196 and two governor valves 198 and 200 at its outlet. A throttle valve test for valve availability is straightforward since the throttle valve to be tested is simply closed and reopened without governor valve closure. Total steam flow is substantially undisturbed since steam flow cutoff in the throttle valve test path is made up by flow in the untested valve path.

Figure 6B:
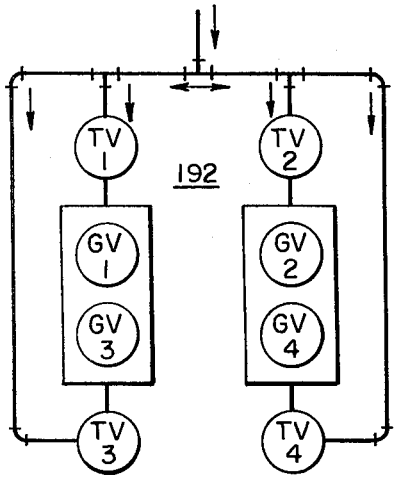
FIGS. 6B through 6I schematically illustrate various other turbine inlet valve configurations.
Figure 6C:
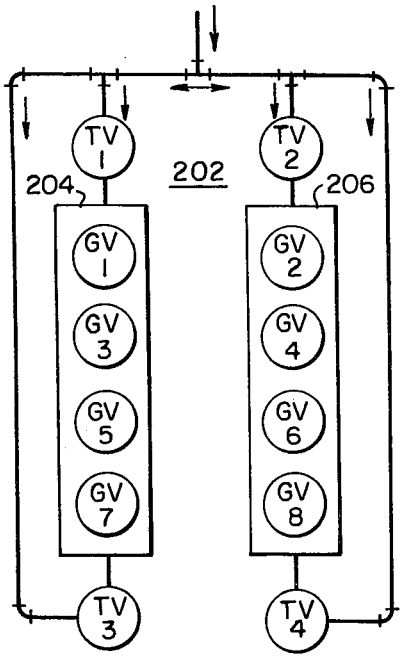

In FIG. 6C, there is shown an inlet valve arrangement 602 similar to the arrangement 192 of FIG. 6B. The arrangement 202 is sold as a Westinghouse BB 22 arrangement for high pressure fossil turbine sections. In the inlet valve arrangement 202, there are a pair of double ended steam chests 204 and 206 having four governor valves each, and it or a similar Westinghouse BB 222 inlet valve arrangement are commonly used in the electric power industry. As in the case of FIG. 6B, a throttle valve test is straightforward for the inlet valve arrangement 202.

Figure 6D:
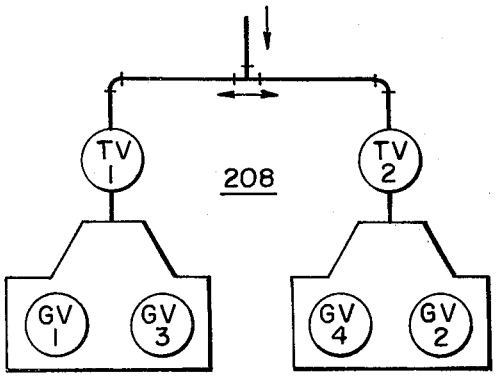

In FIG. 6D, there is shown an inlet valve arrangement 208 which is sold as a Westinghouse BB 95 arrangement for high pressure nuclear turbine sections. The inlet valve arrangement 208 is commonly known as a Y arrangement.

Figure 6E:
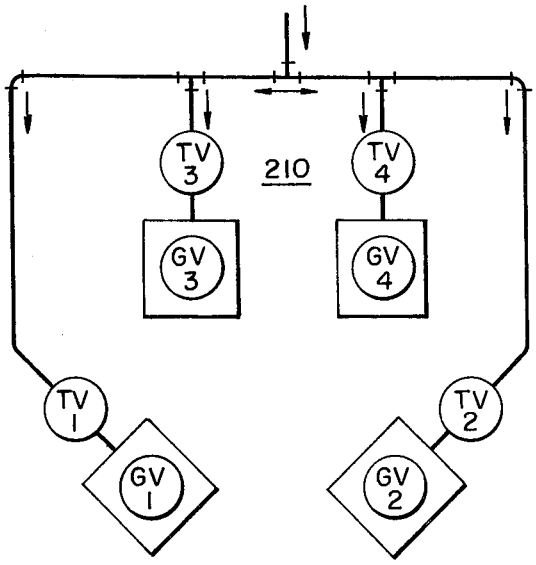

FIG. 6E shows an in-line inlet valve arrangement 210 which is known as the Westinghouse BB 96 arrangement. It is typically used for nuclear turbines above 750 MW rating.

Figure 6F:
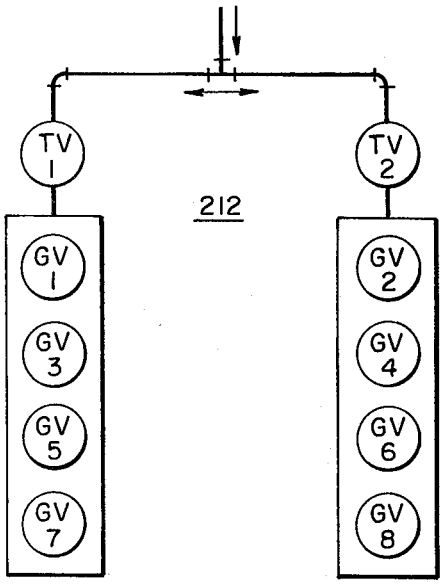
Figure 6G:
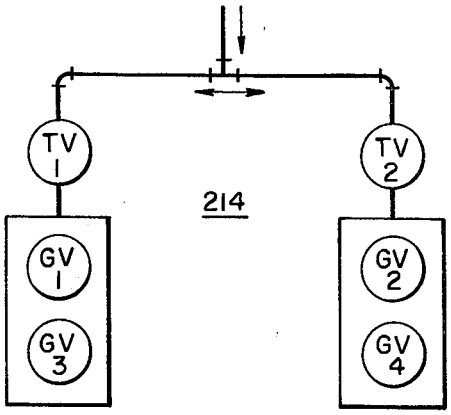
Figure 6H:
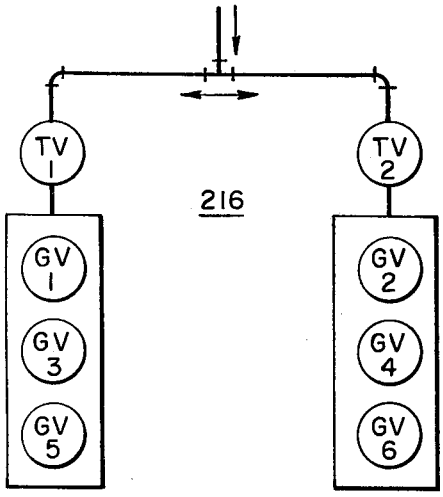
Figure 6I:
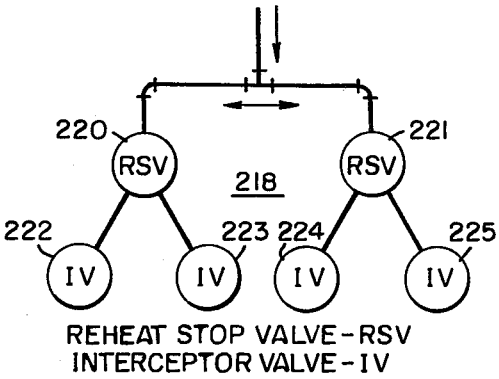

Other inlet valve arrangements 212, 214 and 216 known respectively as the Westinghouse B 44, B 144 and B 145 are shown in FIGS. 6F, 6G and 6H. The arrangements 212, 214 and 216 are typically used with high pressure fossil turbine sections. The inlet valve arrangement 212 of FIG. 6F is like the high pressure turbine inlet valve arrangement of FIG. 1 and it is one of the more commonly used fossil turbine inlet valve arrangements in the electric power industry. In FIG. 6I there is shown an inlet valve arrangement 218 for an intermediate pressure turbine section, and it includes two reheat stop valves 220 and 221 and a pair of interceptor valves 222 and 223 and another pair 224 and 225 downstream respectively from the reheat stop valves 220 and 221.

All of the inlet valve arrangements in FIGS. 6D through 6H require governor valve closure before throttle or stop valve test for the reasons previously described. Similarly, test of the reheat stop valves require closure of the interceptor valves associated with them. The invention is accordingly applicable to various inlet valve arrangements including those of FIGS. 6D through 6H and that of FIG. 6I if the interceptor valves are position controlled.

System For Steam Inlet Valve Testing

Figure 7:
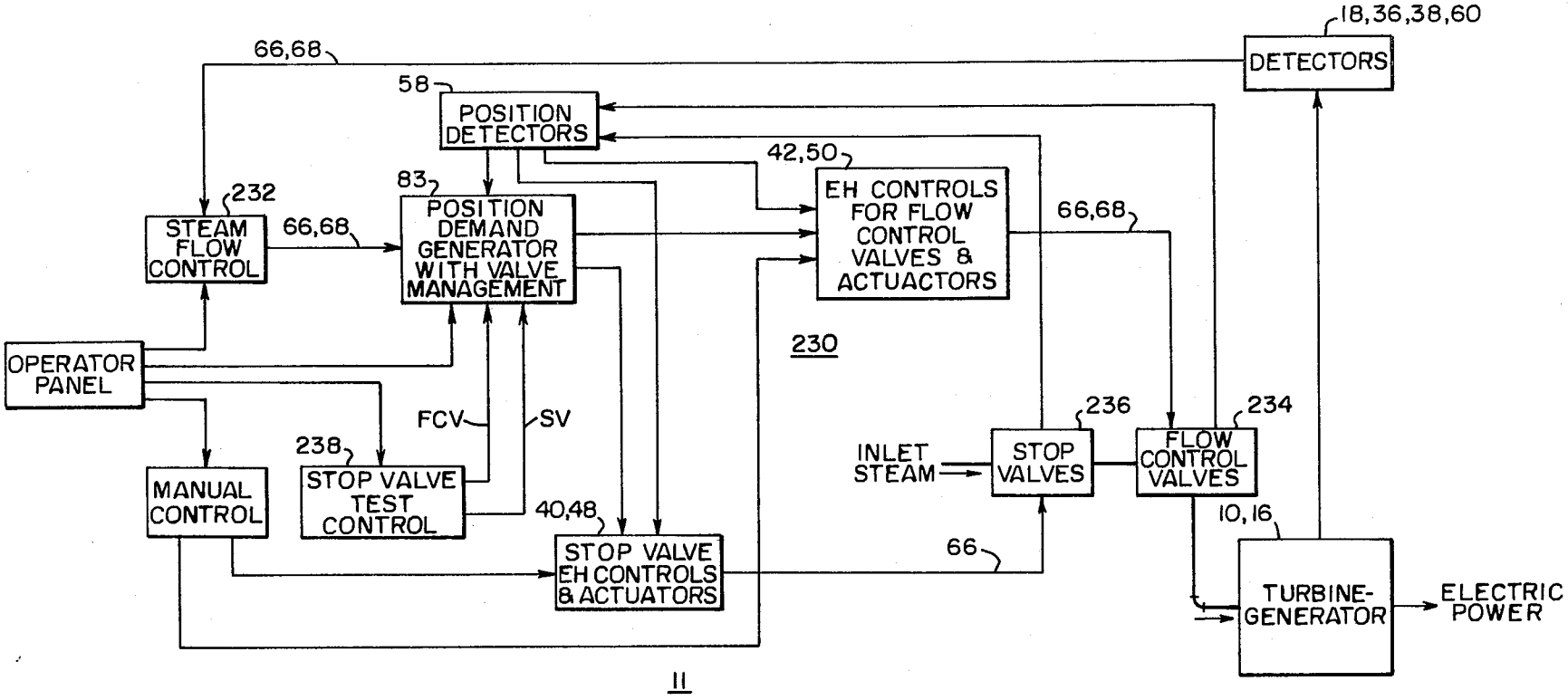
FIG. 7 shows a schematic block diagram of a steam inlet valve testing system which is arranged in accordance with the principles of the invention for incorporation into the power plant shown in FIG. 1.

As shown in FIG. 7, a system 230 is arranged in accordance with the principles of the invention to provide a plant capability for testing for steam inlet valve availability. The valve test system 230 in its preferred form includes previously considered elemental aspects of the control system 11 as functionally diagrammed in FIGS. 3 and 4. In the description of the valve test system 230 and in the related valve test system drawings, like reference characters are therefore employed where functional blocks or structural elements previously considered herein are employed. As already indicated, the present description is directed to disclosure which is aimed at providing a full understanding of the invention, and more complete details on the structure and operation of various control system elements as related to embodiment of the present invention can be obtained in the previously noted copending applications Ser. No. 247,877 and Ser. No. 306,752 which are hereby incorporated by reference.

Prior to and during functioning of the valve test system 230, a steam flow control 232 operates flow control valves 234 which are downstream from stop valves 236 in a turbine inlet valve configuration. In the preferred embodiment, the flow control valves 234 are the governor valves and the stop valves are the throttle valves and the steam flow control 232 is included in the speed control loop 66 and the load control loop 68 which function in the manner previously described to control the speed and load of the turbine-generator 10, 16. Accordingly, in FIG. 7 the steam flow control 232 corresponds to the combination of the frequency participation, megawatt and impulse pressure controls of FIG. 3.

The steam flow control 232 generates a steam flow demand for application to a position demand generator 83 which is similar to the position demand generator 82 of FIG. 3 but which preferably has a valve management capability, i.e. a capability for changing flow control valve or governor valve operating modes substantially without disturbing total inlet steam flow. Single valve and/or sequential valve position demand signals are applied to electrohydraulic controls and in this instance the controls 48 and 50 for the stop or throttle valves and for the flow control or governor valves.

In order to initiate a throttle valve test, a signal is generated at the operator panel to identify a particular throttle valve to be tested and a stop valve test control 238 is coupled to the position demand generator 83 to cause a test signal and preferably a ramp test signal(s) to be generated for closure of the governor valves downstream from the throttle valve to be tested. Thereafter, the stop valve test control is coupled to the position demand generator 83 to cause the throttle valve scheduled for test to be closed and reopened. Subsequently, the closed governor valves are reopened preferably by ramped removal of the test signal(s).

During the test closure of the downstream governor valves in the test path, the position demand generator 83 functions in the load control loop 68 to cause the governor valves in the untested steam path to open and hold total steam flow substantially constant. As is well known, the maximum load at which throttle valve test can be run is determined by the load take-up capability of the governor valves in the untested inlet steam flow path. After test closure and reopening of the tested throttle valve, the position demand generator 83 continues to function in the load control loop 68 to position the governor valves so as to hold steam flow and load substantially constant as the closed governor valves are reopened, i.e. increasing flow through the opening governor valves is offset by closing of the governor valves in the non-tested steam path.

If the turbine 10 is operating in the sequential governor valve mode at a relatively low load, extended test flexibility can be realized. Preferably, the operator generates a panel signal to effect a smooth on line managed transfer from the sequential to the single valve mode substantially without disturbing generated power. Thereafter, the operator initiates a test for throttle valve availability which could otherwise not be performable because the actual load level is below the minimum sequential mode test load set by considerations of rotor or rotor blade stresses associated with sequential valve operation at low loads.

In the preferred embodiment, a digital computer is employed in providing the steam flow control, valve management and position demand functions compatibly with test system functions of governor valve and throttle valve closure and opening in the steam flow test paths. Further, the valve managed position demand signals are preferably generated as feedforward signals which are updated during operation of the position demand generator 83 to reflect actual steam flow after the throttle valve test termination and as the governor valves are being moved from their test mode to their pre-test mode, i.e. either the sequential mode or the single valve mode. Preferably, the control system 11 or specifically the position demand generator 83 is restricted against a governor valve mode transfer from sequential to single valve operation or vice versa during a throttle valve test.

Since the valve test system 230 preferably includes a valve management capability, systems such as that disclosed in the aforementioned Uram copending patent application Ser. No. 247,877 can be used for throttle valve tests where the turbine is provided with steam chests of the end bar lift type. In the event throttle valves associated with double ended steam chests are to be provided with a test capability, there is no need for a test system of the type shown in FIG. 7 and instead the throttle valves can simply be closed and reopened for test purposes in the manner previously described.

Figures 8, 10:
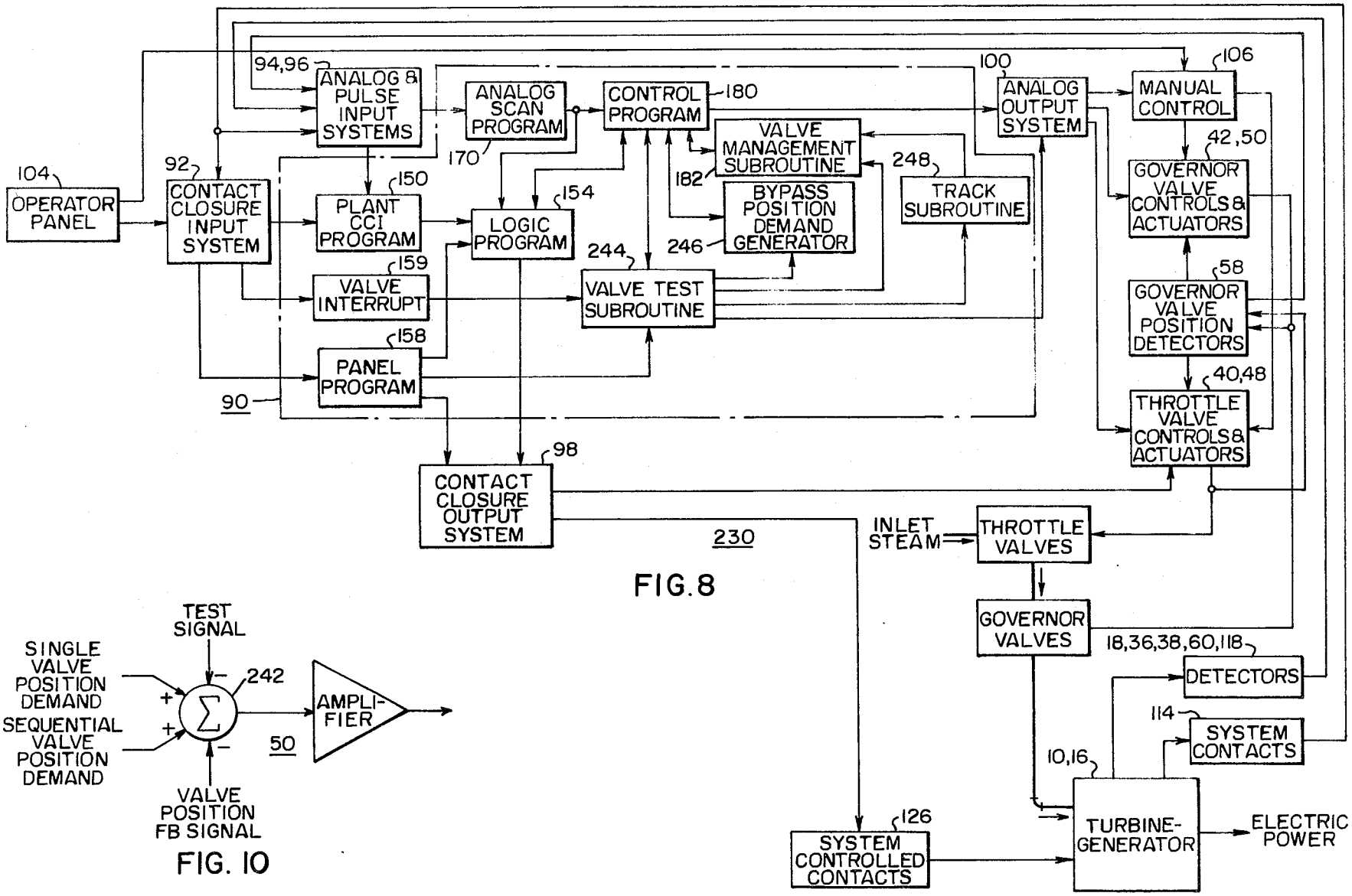
FIG. 8 shows the valve testing system in greater block diagram detail.
FIG. 10 shows a schematic circuit diagram which illustrates the manner in which governor valve operations are implemented through the governor valve electrohydraulic controls during a valve test.
Figure 9:
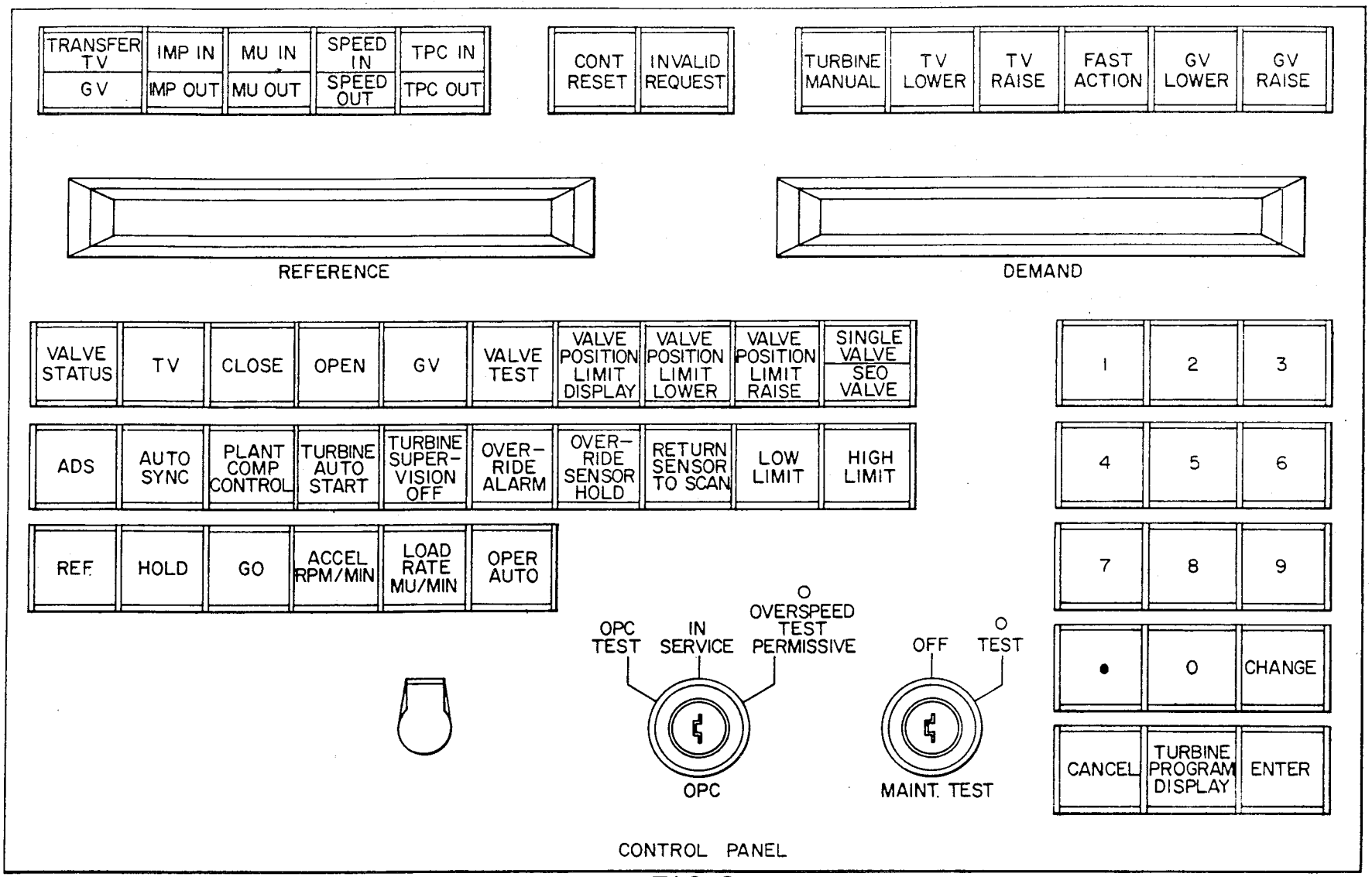
FIG. 9 shows a front view of an operator control panel employed in the valve test system.

As shown in greater detail in FIG. 8, the preferred valve test system 230 includes elements of the digital computer control system described in connection with FIGS. 4 and 5. The operator panel 104 includes a control panel 240 as shown in FIG. 9. The pushbuttons and displays on the control panel 240 are similar to those on the control panel disclosed in the aforementioned copending Uram patent application Ser. No. 247,877.

When a throttle valve test is to be made, the operator presses the VALVE TEST pushbutton on the control panel 240. Next, the throttle valve pushbutton TV is pressed along with a valid throttle valve number. The ENTER pushbutton is next pressed, and finally the CLOSE pushbutton is pressed to initiate the test for the selected throttle valve.

The computer 90 generates test governor valve bias signals through the analog output system 100 to close the governor valves in the test steam path. As shown in FIG. 10, each governor valve control 50 preferably has single valve and sequential valve position demand signals and a position feedback signal and a governor valve test bias signal applied to the input of a summer 242. During a throttle valve test, the governor valve test signal drives the associated electrohydraulic control 50 so as to close the associated governor valve. In the single valve non-test mode, the sequential position demand signals are zero. In the sequential valve non-test mode, the single valve position demand signal is zero.

Once the downstream governor valves in the test steam path are closed, a throttle valve close bias signal is automatically generated and the resultant throttle valve action is verified by a panel indicator (not shown in FIG. 9). Upon release of the CLOSE pushbutton, the computer 90 removes the throttle close bias signal and causes the throttle valve to reopen. When the operator next presses the OPEN pushbutton, the governor valve test signals are ramped to zero and the governor valves are returned to their pre-test mode of operation. If the throttle valve test shows a valve failure, appropriate maintenance is scheduled.

Panel operations are applied to the computer 90 through the contact closure input system 92 when panel interrupts cause the panel program 158 to respond to panel requests. In the functioning of the panel program 158, a panel request can be carried out within the panel program 158 or the panel program can bid the logic program 154 or the visual display program (FIG. 5) to carry out the panel request.

Once a throttle valve test is called by the panel program 158, a valve test subroutine 244 functions as part of the control program 180 to call for the generation of governor valve test signals by the analog output system 100. The resultant test signals are applied to the electrohydraulic controls for the governor valves in the test steam flow path. Each test signal is sized ultimately to offset the governor valve position demand signal so that the test path governor valves are ramped closed. The test signal ramp and the control system response are relatively coordinated so that control loop increases in the position demand signal are sufficiently lagging to avoid prevention of closure of the test path governor valves by the upwardly ramping test bias signals.

To achieve the coordination purpose, the normal valve management subroutine 182 is preferably bypassed by a special linear position demand generator subroutine indicated by the reference character 246 during the test. During operation, the subroutine 246 preferably causes the generation of single valve output signals. Thereafter, the valve management subroutine 182 is updated with current steam demand for post-test operation and the bypass subroutine 246 is made inactive as the valve management subroutine 182 returns to its normal operation after the throttle valve test.

A track subroutine 248 similar to the valve management manual to automatic track subroutine is employed to determine the current load and steam flow demand so as to update the valve management subroutine 182 in preparation for reactivation in the functioning of the control program 180 after the throttle valve test. In the preferred feedforward arrangement, the valve management subroutine accordingly is provided with the necessary inputs for generation of feedforward valve position demands which conform to the existing valve positions at test termination. If the post-test mode is to be the sequential mode, the updating also includes initiating the valve management subroutine for a mode change from the sequential state of the governor valves at the test termination to the normal sequential state for the existing load demand.

The panel program 158 automatically generates a closure signal for the test throttle valve through the contact closure output system 98 once the test path governor valves are closed. The external analog circuitry responds to the CCO by applying a close bias signal to the applicable throttle valve electrohydraulic control 48. The throttle valve response is observed by the operator, and release of the CLOSE pushbutton and pressing of the OPEN pushbutton cause a valve interrupt program 159 to set a flag which causes the valve test subroutine 244 to open the closed throttle valve and ramp the governor valve test signals to zero for the test path governor valves. After the test bias is zeroed and the test path governor valves are reopened, the valve management subroutine updating is effected through selection of the applicable flow curve for current steam flow. During test termination, the load control loop 68 continues to cause the generation of a single valve position signal which meets load demand by opening the test path governor valves as the other governor valves are closed substantially without disturbing total steam flow.

Figure 11:
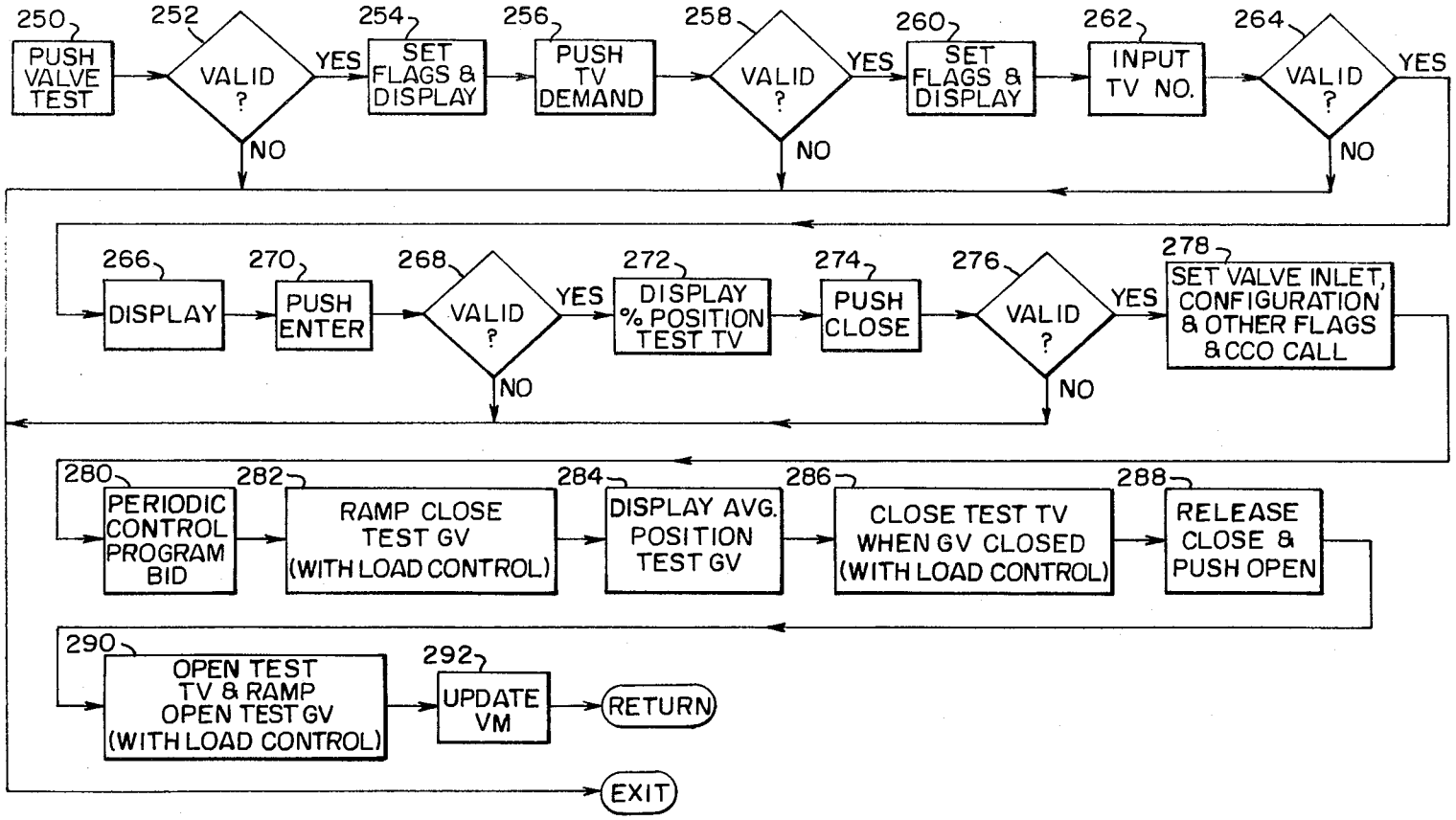
FIGS. 11–14 show various flow charts which represent programs employed in the digital computer of FIG. 4 as part of the valve test system of FIG. 8.

In FIGS. 11–14, there are shown flow charts which schematically illustrate in greater detail the programmed functioning of the computer 90 in the operation of the valve test system 230. In FIG. 11, a chart is shown for the programmed steps employed in the entire valve test process with emphasis on the steps resulting from previously described panel operations. Thus, a block 250 responds to operation of the pushbutton VALVE TEST and if the turbine 10 is not on turbine manual or governor valve mode change or a throttle valve to governor valve transfer and if the request is otherwise valid as indicated by block 252, appropriate display and flags are set by block 254. When the TV button is pushed to identify the test as a throttle valve test as determined by block 256, a validity check is made by block 258 and block 260 sets flags and appropriate display. Next, block 262 determines an input throttle valve number, block 264 checks the validity of the valve number and block 266 provides appropriate display.

A validity check is also made by block 268 on an entry request detected by block 270. Once the entry is validated, block 272 causes a display of the percent position of the throttle valve to be tested. The final panel operation for initiation of a throttle valve test is produced by pressing the CLOSE pushbutton, and this act is detected by block 274, and, if validated by block 276, block 278 sets up the contact closure output calls for valve test operations and further sets various flags including flags which initialize the test for the particular inlet valve configuration, in this instance a pair of single ended steam chests for a HP turbine section. In another case, for example, the initialization could be for an in-line nuclear turbine valve configuration.

The control program 180 is bid periodically as indicated by the reference character 280. On the first control program run after a validated throttle valve test request, block 282 begins to ramp the test path governor valves closed by means of a software ramp which causes a ramp test signal to be applied to the governor valve controls for the governor valves in the test path. Block 284 causes the average test path governor valve position to be displayed. Once the test path governor valves are closed, block 286 generates a close command for the test throttle valve and that command is executed by external contact closure outputs which cause a close bias signal to be applied to the control for the test throttle valve.

After the valve test, the CLOSE pushbutton is released and the OPEN pushbutton is pushed as detected by block 288 in a valve test termination task. Block 290 then causes the test throttle valve and test path governor valves to be reopened in a manner substantially inverse to the manner of closing the valves in the block 282. During the throttle valve test, the control program 180 functions in the load control loop each time it is executed to generate valve position demands which cause the turbine 10 and the plant to meet load demand as indicated in blocks 282, 286 and 290. During throttle valve test initiation and termination, the control program 180 causes overall turbine inlet valve operations which hold steam flow and load substantially constant as individual valve changes are made to satisfy throttle valve test requirements. The previously noted valve management bypass subprogram (not specifically shown in FIG. 11) generates a single valve position demand for the governor valves in the load control loop operation during a throttle valve test.

Once the test path governor valves are closed, block 292 updates the valve management subroutine, i.e. the applicable steam flow versus valve position curve is determined from the existing steam flow demand. Further, appropriate flags are reset and calculations are performed to determine a corrected megawatt demand from impulse pressure feedback and the steam flow demand determined from the applicable steam flow curve on the basis of current governor valve positions, a frequency corrected load demand from the megawatt feedback and the corrected megawatt demand, and finally the load demand from the speed feedback and the frequency corrected load demand.

If the system is to return to the single valve mode of governor valve operation, the return from the valve test status is completed and the control program 180 and the control system 11 return to normal control loop operation with the generation of a single valve analog output signal. If the system is to return to the sequential mode of governor valve operation, the valve management subroutine 182 on successive post-test program runs initiates a mode change, i.e. it initiates the generation of sequential analog output signals as the single valve analog output signal is reduced to zero so as to cause bumpless repositioning of the governor valves from their post-test sequential state to the sequential state which would normally be required to satisfy the current steam flow demand in the governor valve sequential mode.

Figure 12:
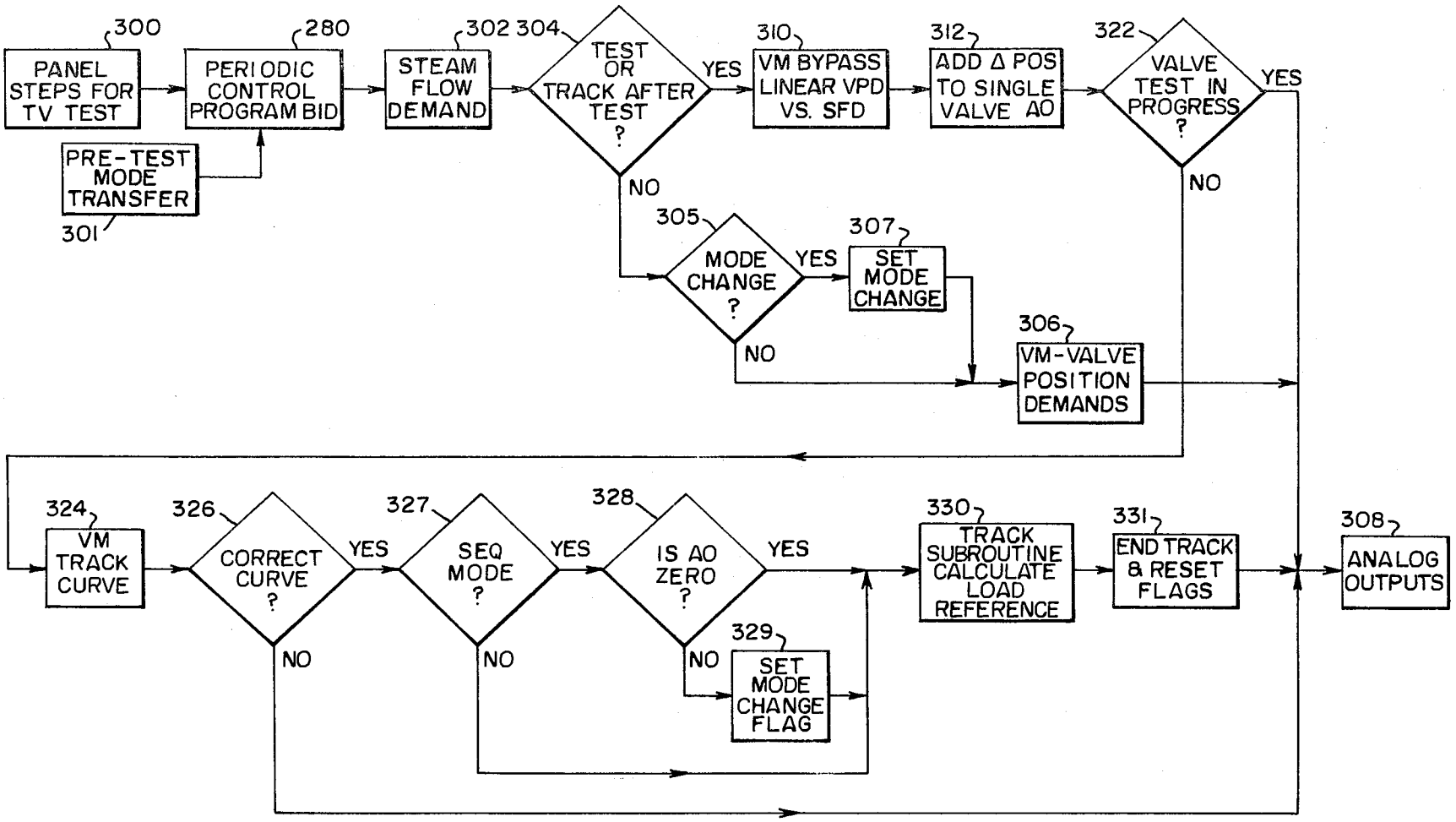

In FIG. 12, the programmed computer part of the test process is illustrated with emphasis on the control program 180. Thus, panel steps indicated by block 300 include the panel steps noted in connection with FIG. 11. Where it is desired to transfer the system from sequential governor valve operation to single governor valve operation prior to initiation of a load test so as to obtain reduced rotor and/or rotor blade stress loading at lower load levels, a mode transfer is first executed on line as indicates by block 301 and the panel steps 300 are then implemented. This results in greater testing flexibility than would ordinarily be otherwise obtainable.

Each time the control program 180 is run, a steam flow demand is generated as indicated by block 302. If block 304 shows no throttle valve test nor no track after test, the valve management subroutine 182 calculates valve position demands for the single valve or sequential valve modes as indicated by block 306. Block 308 then generates corresponding analog output signals to position the steam valves for turbine operation at the demand load level. If a sequential to single valve mode change has been requested prior to test, the blocks 302, 304 and 306 respond to implement the mode change as indicated by blocks 305 and 307.

After a requested throttle valve test or track after test, blocks 310 and 312 of the control program 180 cause a single valve position demand to the generated as a linear function of the steam flow demand. In the preferred embodiment, the bypass linear valve characterization function is employed in place of the nonlinear valve management valve characterization function so that the system can be tuned for governor valve closure upon the generation of governor valve test close bias ramp signals. Without the linear bypass function, the control loop operation can in various circumstances cause position demand signals to change correctively so fast in response to the test governor valve ramp signal that the test path governor valves never would close for test purposes.

Figure 13:
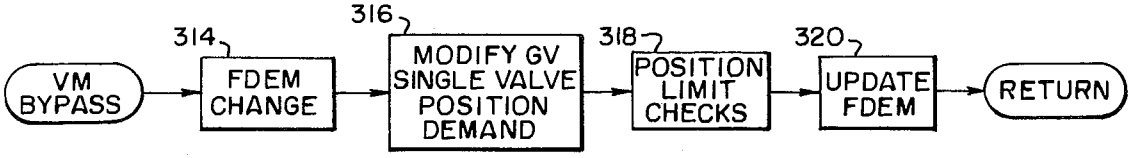

As shown more fully in FIG. 13, block 314 in the valve management bypass task first calculates the change in the steam flow demand form the last control program run. Block 316 next modifies the single valve position demand for the governor valves in accordance with the change in the steam flow demand. The previously noted linear characterization is used for this purpose. Block 318 applies limit checks to the valve position demand, and block 320 changes the stored steam demand value from the last value to the current value in preparation for the next program run.

While the valve test is in progress as indicated by block 322 (FIG. 12), the block 308 generates the analog inputs corresponding to the results of operation by the blocks 310 and 312. Once the test throttle valve is reopened and the governor valves are reopened, i.e. once the governor valve test signals are zero, a block 324 of the valve management track subroutine searches for the correct flow curve. In many cases, the correct flow curve is found in the present embodiment after one program run since a fixed flow coefficient is employed for loads up to 70% and a throttle valve test often would not be performed at load levels above 70%. Accordingly, the valve management bypass blocks 310 and 312 can be excluded from system opertion if desired once the valve test is no longer in progress and the governor valve test signal is made zero (not omitted in FIG. 12), and a smooth transition nonetheless can be made from the last single valve analog output signal to new analog output signals which may come with reinstated valve management operation of the load control loop. If more than one search run is required for the steam flow curve, it is possible that load demand would change and in that case the program arrangement of FIG. 12 is preferred.In a detailed program listing set forth subsequently herein, the valve management bypass functions only during test progress and not thereafter.

After the correct steam flow curve is found as indicated by block 326, blocks 327 and 328 determine whether the post-test governor valve mode is to be the sequential mode and whether the present single valve analog output is greater than zero. If so, block 329 sets a mode change flag. Next, a block 330 of the track subroutine calculates the updated load demand as already described. Block 331 then resets appropriate flags and ends the track operation.

Figure 14:
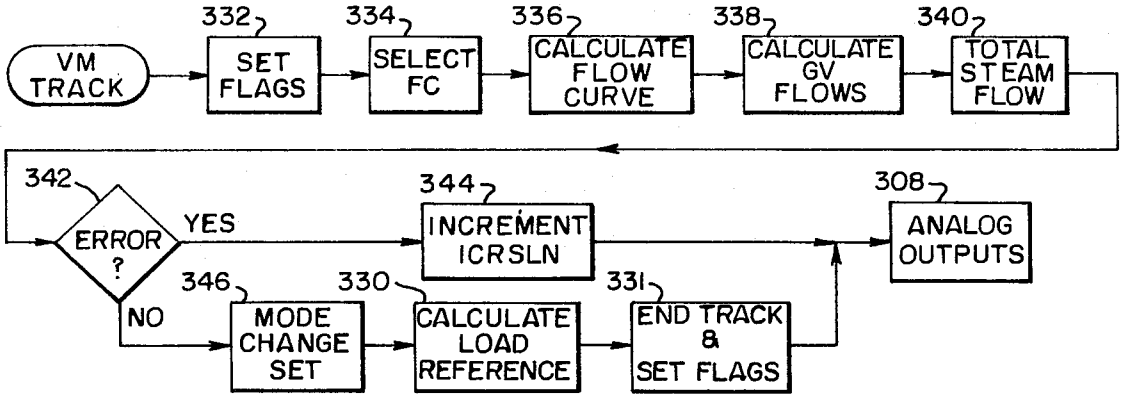

In FIG. 14, the valve managment track operation is shown in greater detail. Thus, block 332 first sets appropriate flags and block 334 makes a flow coefficient selection from a stored flow coefficient versus flow curve. The lowest flow coefficient (i.e. the coefficient valid for up to 70% load) is selected first and if additional program runs are required for flow curve selection next higher flow coefficients are successively selected.

Block 336 next calculates a steam flow versus valve position curve from a stored flow versus position curve and the selected flow coefficient. Where the lowest flow coefficient is selected, i.e. FC=1, the stored steam flow curve is implemented as stored. Where flow coefficients associated with higher loads are selected on subsequent program runs, the block 336 calculates the steam flow curve by multiplying the flow coefficient against the stored steam flow curve.

Block 338 next uses the most recent governor valve feedback positions to compute the steam flow through each governor valve from the selected steam flow curve. A DO loop is used for this purpose. Block 340 then calculates the total steam flow.

In the next step, block 342 compares the calculated steam flow for the selected flow coefficient. Thus, if the calculated steam flow is less than 70% and the selected steam flow is 70%, no error exists and the correct steam flow curve is selected. If the calculated steam flow is greater than 70% and the selected steam flow is less than the calculated flow, block 344 increments the selector so that the next higher flow coefficient is employed in the next control program run. If the calculated steam flow is greater than 70% and the selected steam flow is greater than the calculated steam flow, the block 344 causes a restart of the search cycle with a flow coefficient selection corresponding to 70% load. If the calculated steam flow and the selected steam flow are greater than 70% and substantially equal, no error exists and the correct steam flow curve is selected.

Once the correct curve is selected, blocks 327, 328 and 329 perform as described in connection with FIG. 12 and as indicated by the reference character 346 in FIG. 14. Track subroutine blocks 330 and 331 also perform as previously described. The turbine 10 is then bumplessly returned to speed and load control required governor valve position changes made under valve management in the manner previously described.

In the appendix, there is disclosed a Fortran listing of programmed computer steps which form a part of a complete program system for the computer 90 and which represent the program steps most directly related to an embodiment of a turbine valve test system arranged in accordance with the principles of the invention. Generally, the listing embodies program functions like those described herein with respect to operation of the valve test system.

In summary , a valve test system operates to provide extended flexibility in testing for valve availability through the pre-test implementation of valve mode changes on-line without power generation interruption especially at lower load levels where sequential governor valve operation could produce undesirable rotor or rotor blade loading during test. Further, the turbine valves downstream from the valves to be tested are operated with feedforward position control during normal turbine control operations and test valve closings and openings are made compatibly with the feedforward control so that substantially bumpless automatic load control is retained as the turbine valve tests are started, conducted and terminated.

A P P E N D I X

Fortran Listing - Valve Test System Programs

PANEL

```
C                    VALVE STATUS BUTTON
C
22      VSTATUS=.TRUE.
        IPBX= 8
        GO TO 100
C
C                    TV BUTTON
C
23      IF(NVTEST .NE. 0)GO TO 4106
        IF(.NOT. STOPVLVS)GO TO 230
        IF(.NOT. VTESTPB) GO TO 2000
230     IF(.NOT. VSTATUS) GO TO 2000
        TV=.TRUE.
        GV=.FALSE.
        CALL M:CCS( 1, 4, 11, 12)
        GO TO 115
C
C                    GV BUTTON
C
24      IF(NVTEST .NE. 0) GO TO 4106
```

```
      IF((.NOT. VSTATUS) .OR. VTESTPB) GO TO 2000
      GV=.TRUE.
      TV=.FALSE.
      CALL MICCO( 1, 8, 11, 12)
      GO TO 115
C
C                    VALVE TEST BUTTON
C
25    IF(TM .OR. MODCH .OR. TRFPG)GO TO 2000
      VTESTPB=.TRUE.
      CALL MICCO( 1,ON, 11, 16)
      IF(NVTEST .EQ. 0) GO TO 22
      IF(ITYPTEST .EQ. 4) GO TO 255
      CALL MICCO( 1, 4, 11, 12)
      TV=.TRUE.
      INDEX2=NVTEST
      GO TO 22
255   CALL MICCO(1,8,11,12)
      GV = .TRUE.
      INDEX2 = NVTEST
      GO TO 22
```

```
C
28    KEY=IPB-27
      GO TO 410
C
C                    KEYBOARD BUTTONS (4) TO (9)
C
33    KEY=IPB-29
      GO TO 410
C
C
C                    ENTER BUTTON
C
44    IF((IPBX .EQ. 1) .AND. (AS .OR. ATS .OR. ADS .OR. INVREQ)
     1   .OR. ENTERPB) GO TO 4106
      ENTERPB=.TRUE.
      J=1
440   IDM=1000
      IWINDOW=0
      DO 444 JJ= 1, 4
      I= 5-JJ
      IWINDOW=IWINDOW+IDM*IW(I)
      IDM=IDM/ 10
444   CONTINUE
      DADR=.FALSE.
      GO TO (445,170,4450),J
445   VDISPLAY=IWINDOW
      IF((IPBX .EQ. 7) .AND. DATENTRY) GO TO 4460
4450  GO TO (4400,4402,4402,4401,4408,4106,441,442,4404),IPBX
C                    CLOSE/OPEN BUTTON
C
5152  IF(.NOT. (VTESTPB .AND. TV .AND. (INDEX2 .GT. 0) .AND.
     1          (INDEX2 .LE.NTV))) GO TO 2000
5155  IF(SINGEND) GO TO 5156
      ITYPTEST = 0
      GO TO 5154
5156  IF(NUCINLIN) GO TO 5157
      ITYPTEST = 3
```

```
      GO TO 5154
5157  ITYPTEST = 1
5154  NV=ITYPTEST * 4 + INDEX2
5158  IVTPAT1 = ITESTPAT(NV)
      IF(IPB.EQ.52) GO TO 52
C
C                          CLOSE BUTTON
51    CLOSEPB = .TRUE.
      CALL M:CCO (1, ON, 13, IVTPAT1)
      NVTEST = INDEX2
      GO TO 2000
C
C                          OPEN BUTTON
52    OPENPB = .TRUE.
      GO TO 2000
C
                                CONTROL
C
C                 VALVE TEST PROGRAM
C
C*****************************************************************
C
10    VT=.FALSE.
      IF(TESTAO.NE.0.) VT=.TRUE.
      IF(TM) GO TO 33
15    IF(ITYPTEST.EQ.3) GO TO 28
27    IF(.NOT. CLOSEPB) GO TO 30
      J = 4
      IF(ITYPTEST.EQ.0) GO TO 46
      IF(ITYPTEST.EQ.3) GO TO 18
      TEMP=IGVSS(INDEX2)
      TEMP=TEMP/40.96
      IF(TEMP .LE. CLOSEDB) GO TO 21
16    TEMP = VTESTINC
      GO TO 40
18    LCLOSE = .TRUE.
      TEMP = ITSTDISP
      TEMP = TEMP/40.96
      IF(TEMP.GT.CLOSEDB) LCLOSE = .FALSE.
      IF(LCLOSE) GO TO 20
      GO TO 16
20    J = 13
      IF(STOPVLVS) J=4
21    IF(GV) GO TO 46
      IVTPAT2 = ITESTPAT(INDEX2)
      CALL M:CCO( 1,IVTPAT2,J,IVTPAT2)
      GO TO 46
28    ITSTDISP = 0

      N = NOVLV/2 -1
      DO 29 I=0,N
      K  =  INDEX2  +  2*  I
      ITSTDISP = ITSTDISP + IGVSS(K)
29    CONTINUE
      ITSTDISP = ITSTDISP/(N+1)
      GO TO 27
30    IF(ITYPTEST.EQ.0) GO TO 46
      IF(.NOT. OPENPB) GO TO 46
      TEMP = VTESTINC
32    IF(TESTAO.GE.TEMP) GO TO 39
33    IF(TM) NVTEST = 0
      TESTAO =0.
      GO TO 44
39    TEMP = -TEMP
40    TESTAO=TESTAO+TEMP
44    IPATTEST=20.47*TESTAO
      IF(IPATTEST.GE.2047)IPATTEST=2047
45    CALL M:CCO(1,IPATTEST,27,MASK)
C
```

VALVE TEST
PUSH BUTTON RESET TASK

```
67    IF(CLOSEPB) GO TO 50
      IF(OPENPB) GO TO 100
C
C                 RESET THROTTLE VALVE CLOSE TEST BUTTON
C                       AND THROTTLE VALVE TEST CONTACT
C
50    CLOSEPB=.FALSE.
      IF (GV) GO TO 105
      IPAT = IVTPAT2
      IF(ITYPTEST.EQ.0) IPAT=IVTPAT1
      NWD = 13
      IF (STOPVLVS) NWD= 4
      GO TO 200
C
C                 RESET THROTTLE VALVE OPEN TEST BUTTON
C                       AND GOVERNOR VALVE TEST CONTACT
C
100   OPENPB=.FALSE.
105   IF(TESTAO .NE. 0.) GO TO 1000
      NVTEST=0
      IPAT = IVTPAT1
      NWD = 13
200   CALL M:CCO( 1, 0,NWD,IPAT)
      IF(ITYPTEST.EQ.0) NVTEST=0
C
1000  CALL EXIT
      GO TO 67
      END
```

VALVE MANAG.
PROGRAM

```
51    LOOPOUTX = LOOPOUT
      IF(VT.AND. (.NOT. TM))GO TO 1500
      FDEMX = FDEM
      IF(FDEM.LT.0.) FDEM=0.
      FTEMPY=FDEM/PCORF
      LPCORR=.FALSE.
      IF(FLPCORR.GT.0.) LPCORR=.TRUE.
      IF(VCHDR.OR.MODCH) BYPASS=.FALSE.
      VLVOPN=.FALSE.
      IF(FTEMPY.GT.100.) GO TO 50
 10   IF(VCHDR) GO TO 905
 1    FTEMP1=ABS(FDEM-FTOTAC)
       IF(TRFPG) GO TO 70
      IF(.NOT.TRCOM) GO TO 17
       IF(MODCH) GO TO 70
17     FTOLR=FTOLRF
 7     IF(FTEMP1.LT.FTOLR) GO TO 2
      FLOCH=.TRUE.
      DELFT=FDEM-FTOTAC
      GO TO 200
 50   FDEM=100.*PCORF
      VLVOPN=.TRUE.
      GO TO 10
 70    FTOLR=FTOLRH
       GO TO 7
 2    FLOCH=.FALSE.
      IF(.NOT.(MODCH))GO TO 3
      FC1=FC
      FA1=FA
      TRFPG=.FALSE.
      TRFCOM=.FALSE.
      GO TO 200
```

```
 3      IF(TRFPG) GO TO 500
        FTEMP1=PCORF*(100.-FTOLRF)
        IF(FDEM.GT.FTEMP1) GO TO 52
        IF(FDEM.LT.FTOLRF) GO TO 53
54      FTEMP1=ABS(PO-POLAST)
         IF(FTEMP1.LT.PDBND) GO TO 71
        IF(.NOT.(TPXDOK.AND.LPCORR)) GO TO 71
        FLOCH=.TRUE.
         GO TO 200
71      GO TO 999
52      IF(HISLOPE) GO TO 54
53      IF(FDEM.EQ.FTOTAC) GO TO 54
        FLOCH=.TRUE.
C*****************************************************************
C
C       VALVE  CURVE SELECTION SUBPROGRAM
C
C*****************************************************************
 200    IF(FTEMPY.GE.100.) GO TO 277
        HISLOPE=.FALSE.
        FTOLRF=FTOLRFLO
        PDBND=PDBNDL
        GO TO 278
 277    HISLOPE=.TRUE.
        FTOLRF=FTOLRFHI
        PDBND = PDBNDH
 278    IF(.NOT.(LPCORR)) GO TO 210
        IF(.NOT.(TPXDOK)) GO TO 220
         PDEV=PO-POLAST
         PDEVA=ABS(PDEV)
         IF(PDEVA.LT.PDBND) GO TO 220
         IF(PDEVA.LE.MXPDEV) GO TO 261
         IF(PDEV.GT.0.) GO TO 260
         PDEV=-MXPDEV
         GO TO 261
 260     PDEV=MXPDEV
 261     POLAST=POLAST+PDEV
         PCORF=POLAST/POREF
        GO TO 220
 210    PCORF=1.
        POLAST=POREF
220     IF(VLVOPN)FDEM=100.*PCORF
        IF(FASUM.GT.FDCF(2)) BYPASS=.FALSE.
        FASUM=FDEM/PCORF
        IF(BYPASS) GO TO 229
        GO TO 1200
 225    DO 227 KCNT3=NPSTRT,NOPPCV
        FL(KCNT3)=FLIN(KCNT3)*FLCOEF
        IF(KCNT3.EQ.NOPPCV) GO TO 227
        PZ(KCNT3)=(PZI(KCNT3)*FLCOEF)+PZ(2)
 227    CONTINUE
        FVLMX=(PCORF*FWMXB)*FLCOEF
        FTEMPZ=FWMXB
        FTEMP1=FVLMX/TNONOZ
        DO 226  KCNT1=1,NOVLV
        FVMX(KCNT1)=FTEMP1*NCNOZ(KCNT1)
 226    CONTINUE
229     IF(VCHOR) GO TO 947
        IF(.NOT.(FLOCH)) GO TO 100
        IF(TRFPG.OR.P100) GO TO 700
        GO TO 106
C
C     TRACKING SUBPROGRAM
C
C*****************************************************************
905     TRFPG=.FALSE.
        P900 =.FALSE.
        IF(.NOT. (TPXDOK .AND. LPCORR)) GO TO 937
        POLAST=PO
        PCORF=POLAST/POREF
 936    IF(ICRSLN.LT.INTRIES) GO TO 1200
1998    FLCOEF=COEFSL
        TEMPLOG=.TRUE.
        GO TO 225
```

```
922    IF(TEMPLOG.OR.CRVSELOK) GO TO 939
       ERRTRC=FASUM-FTOTCC
       ERRABS=ABS(ERRTRC)
       IF(ERRABS.GT.ERRMIN) GO TO 923
       ERRMIN=ERRABS
       COEFSL=FLCOEF
       FTOTRC=FTOTAC
 923    FASUM=FASUM+FINCR
1922   ICRSLN=ICRSLN+1
       CRVSELOK=.FALSE.
       IF(FASUM.GT.100.) FASUM=100.
       IF(ERRTRC) 939,1998,1998
 947   KTEMP1=2*(IGVAD(1)-1024)
       FTOTAC=0.
          GVPZC=KTEMP1
       GVPZC=GVPZC/CONV
       DO 910 M=1,NOVLV
       L=M+1
       GVPZT=IGVAD(L)
       GVPZT=GVPZT/CONV+GVPZC
       IF(GVPZT.LT.0.) GO TO 979
 917   DO 915 J=1,NOPPCV
        PZC=PZ(J)
        IF(GVPZT.LT.PZC) GO TO 920
 915   CONTINUE
       FLOW=FL(NOPPCV)
       GO TO 1920
 920   K=J+FPTCSL-1
       FLOW=FL(K)-FL(K-1)
       FLOW=FLOW/(PZ(J)-PZ(J-1))
        FLOW=FLOW*(GVPZT-PZ(J-1))
       FLOW=FLOW+FL(K-1)
1920   FLOW=FLOW*PCORF
       FACT(M)=FLOW
       FTOTAC=FTOTAC+FLOW
 910    CONTINUE
       FTOTCC=FTOTAC/PCORF
       IF(P900) GO TO 965
       IF(.NOT.(DA)) GO TO 922
       IF(VTTRACK) GO TO 922
 938   IF(SINGLV) GO TO 960
 963   MODCH=.TRUE.
       IF(.NOT.VTTRACK) GO TO 964
       IF(IGVAD(1).EQ.0) MODCH =.FALSE.
 964   P900=.TRUE.
       FASUM=FDEM/PCORF
       GO TO 1200
 965   VCHDR=.FALSE.
       ERRMIN=1000.
        FASUM=FMINAS
       TEMPLOG=.FALSE.
       CRVSELOK=.FALSE.
       IF(.NOT.MODCH) P900=.FALSE.
       HISLOPE=.FALSE.
1964   ICRSLN=0
       FTOTAC=FDEM
       P100=.FALSE.
       P600=.FALSE.
       IF(.NOT.VTTRACK) GO TO 958
       CALL TRACK
       VTTRACK =.FALSE.
  958  GO TO 1
 960   DO 961 M=1,NOVLV
       N=M+1
       IF(IGVAD(N).GT.ICOTLR) GO TO 963
 961   CONTINUE
       GO TO 964
 939   FDEM=FTOTAC
       FTEMP1=ABS(FTOTAC-FTOTRC)
       IF(FTEMP1.GT.TRCTOLR)  GO  TO 1993
       IF(.NOT.(TEMPLOG))  GO TO 999
       TEMPLOG=.FALSE.
       CRVSELOK=.TRUE.
```

```
      IF(VTTRACK) GO TO 938                                          0605
      GO TO 999                                                      0606
1993   IF(TEMPLOG) GO TO 1994                                        0607
      IF(.NOT.(CRVSELOK)) GO TO 999                                  0608
1994   TEMPLOG=.FALSE.                                               0609
      CRVSELOK=.FALSE.                                               0610
      ICRSLN=0                                                       0611
      FASUM=FMINAS                                                   0612
      ERRMIN=1000.                                                   0613
      GO TO 999                                                      0614
955     IGVAO(1)=2047                                                0615
      GO TO 999                                                      0616
979    GVPZT=0.                                                      0617
      GO TO 917                                                      0618
937    PCORF=1.                                                      0619
      POLAST=POREF                                                   0620
      GO TO 936                                                      0621
1200 K=1                                                             0649
      DO 1201 J=1,NOFCFP                                             0650
      FLCAS=FDCF(J)                                                  0651
      IF(FASUM.LT.FLCAS) GO TO 1202                                  0652
      K=K+1                                                          0653
1201    CONTINUE                                                     0654
       FLCOEF=COEF(NOFCFP)                                           0655
       GO TO 225                                                     0656
1202   FLCOEF=COEF(K)-COEF(K-1)                                      0657
       FTEMP1=FDCF(J)-FDCF(J-1)                                      0658
       FLCOEF=FLCOEF/FTEMP1                                          0659
       FTEMP1=FASUM-FDCF(J-1)                                        0660
       FLCOEF=FLCOEF*FTEMP1                                          0661
       FLCOEF=FLCOEF+COEF(K-1)                                       0662
       GO  TO 225                                                    0663
 1500 VCHOR =.TRUE.                                                  0664
       VTTRACK =.TRUE.                                               0665
       TEMP = (FDEM - FDEMX)*GR11                                    0666
       ITEMP= TEMP                                                   0667
       IGVAO(1) = IGVAO(1) + ITEMP                                   0668
       IF(IGVAO(1).GT.2047) IGVAO(1)=2047                            0669
       IF(IGVAO(1).LT.0) IGVAO(1)=0                                  0670
       FDEMX = FDEM                                                  0671
 999   RETURN                                                        0672
       END                                                           0673
C
       IF(VTTRACK) GO TO 7030                                        0130
       READY=.FALSE.                                                 0131
       VCHOR=.TRUE.                                                  0132
       IGVAO(10) = IGVAO(10)+ (ITVMAN - ITVAO)/2                     0133
       IF(THI) IGVAO(10)=2047                                        0134
       IF (IGVAO(10) .LT. 0) IGVAO(10) = 0                           0135
       IGVAO(1) = IGVAO(1) + (IGVMAN - IGVAO)/4                      0136
       IF(IGVAO(1) .LT. 0) IGVAO(1)=0                                0137
       DO 7020 I=1,10                                                0138
       IF((I .GE. 2) .AND. (I .LE. NOVLV +1)) IGVAO(I)=ISQAO(I-1)/2  0139
       IF(IGVAO(I) .GE. 2047) IGVAO(I)=2047                          0140
7020   CONTINUE                                                      0141
7030   IF(TRCOM .OR. STOPVLVS) GO TO 7100                            0142
C                                                                    0143
C                                                                    0144
C                TRACK SPEED CONTROL - THROTTLE VALVE CONTROL        0145
C                                                                    0146
       CRVSELOK=.TRUE.                                               0147
       TEMP=IGVAO(10)                                                0148
       RESSPD=TEMP/GR6                                               0149
       FTOLRF=0.                                                     0150
       GO TO 7300                                                    0151
 7100 IF(VTTRACK) GO TO 7150                                         0152
       CALL VMGT                                                     0153
 7150 IF (BR) GO TO 7500                                             0154
C                                                                    0155
C                                                                    0156
C                TRACK SPEED CONTROL - GOVERNOR VALVE CONTROL        0157
C                                                                    0158
       RESSPD=FDEM/GR7                                               0159
7300   RESSPD=WR*RESSPD/100.                                         0160
       RESSPDX=0.
```

```
      REFDMD=WS                                                         0161
      IF(.NOT. ASL) REFDMD=0.                                           0162
      GO TO 7600                                                        0163
C                                                                       0164
C                    TRACK LOAD CONTROL                                 0165
C                                                                       0166
 7500 PISP=(FDEM*GR4)/100.                                              0167
      IF (.NOT.IPI) GO TO 7510                                          0168
      RESPI=PISP                                                        0169
      RESPIX = 0.                                                       0170
      PISP = PI                                                         0171
 7510 REF2 = PISP/GR3                                                   0172
      REF1 = REF2                                                       0173
      IF (.NOT.MWI) GO TO 7520                                          0174
      REF1 = MW                                                         0175
      RESMW = REF2/REF1                                                 0176
      RESMWX = 0.                                                       0177
 7520 REFDMD = REF1*X                                                   0178
      IF(REFDMD .GE. MWMAX) REFDMD=MWMAX                                0179
 7600 GDMD=REFDMD                                                       0180
      IF(VTTRACK) GO TO 7650                                            0181
      TEMP=ITVAO-ITVMAN                                                 0182
      TEMP1=ISVAO-IGVMAN                                                0183
      TEMP2 = ITESTAO                                                   0184
      IF((ABS(TEMP) .LT. DBTRKS) .AND. (ABS(TEMP1) .LT. DBTRKL)         0185
     1  .AND. CRVSELOK .AND. (.NOT. VIDARJS) .AND. (TEMP2   .LE.        0186
     1  TESTAIMX)) READY = .TRUE.                                       0187
      CALL M:CCO( 1,IGVAO(1),NREGGVAO,MASK)                             0188
      CALL M:CCO( 1,IGVAO(10),NREGTVAO,MASK)                            0189
 7650 RETURN                                                            0190
      END
```

What is claimed is:

1. A steam turbine arrangement comprising a plurality of turbine sections and an inlet valve configuration including at least two main inlet valves and a plurality of position controllable valves downstream from each main inlet valve to supply steam to one of the turbine sections for driving a turbine rotor, means for operating said main inlet valves, means for positioning said downstream valves to satisfy a steam flow demand in a sequential valve mode or a single valve mode, means for closing and reopening the downstream valves associated with a main inlet valve to be tested as said positioning means operates the downstream valves to satisfy the steam flow demand substantially without disturbing the turbine load generation, means for transferring said downstream valves between sequential and single valve operating modes during turbine load operations and prior to a main inlet valve test substantially without disturbing the turbine load generation, and means for operating said main inlet valve operating means to close and reopen the main inlet valve to be tested after closure and prior to reopening of the associated downstream valves.

2. A turbine arrangement as set forth in claim 1 wherein a digital control computer is provided, said computer including means for generating main inlet valve operating signals and a main inlet valve test closure signal to function as part of said main inlet valve operating means, and said digital computer further including means for generating downstream valve position signals and downstream valve test closure signals to function as part of said downstream valve positioning means.

3. A steam turbine arrangement comprising a plurality of turbine sections and an inlet valve configuration including at least two main inlet valves and a plurality of position controllable valves downstream from each main inlet valve to supply steam to one of said turbine sections for driving a turbine rotor, means for operating said main inlet valves, means for generating feedforward signals representative of the positions of said downstream valves needed to satisfy a steam flow demand, means for positioning said downstream valves in accordance with the feedforward position signals, means for closing and reopening the downstream valves associated with a main inlet valve to be tested as said generating and positioning means operate the downstream valves to satisfy steam flow demand substantially without disturbing the turbine load generation, and means for operating said main inlet valve operating means to close and reopen the main inlet valve to be tested after closure and prior to reopening of the associated downstream valves.

4. A steam turbine arrangement as set forth in claim 3 wherein the main inlet valves are throttle or stop valves for a high pressure turbine section and the downstream valves are governor or control valves for the high pressure turbine section, and the steam flow demand is a demand which corresponds to a load demand.

5. A steam turbine arrangement as set forth in claim 3 wherein a digital control computer is provided, said computer including means for generating main inlet valve operating signals and a main inlet valve test closure signal to function as part of said main inlet valve operating means, and said digital computer further including means for generating feedforward downstream position signals and downstream test closure signals to function as part of said generating and positioning means.

6. A steam turbine arrangement as set forth in claim 5 wherein the main inlet valves are throttle or stop valves for a high pressure turbine section and the downstream valves are governor or control valves for the high pressure turbine section, and the steam flow demand is a demand which corresponds to a load demand.

7. A steam turbine arrangement as set forth in claim 3 wherein said feedforward generating means generates feedforward position signals in accordance with a nonlinear characterization during normal operation and in accordance with a substantially linear characterization during test operation, and means are provided for modifying said feedforward generating means so that it functions with the nonlinear characterization to generate feedforward position signals which satisfy existing steam flow demand in accordance with the nonlinear characterization as the valve test is ended.

8. A steam turbine arrangement as set forth in claim 7 wherein the main inlet valves are throttle or stop valves for a high pressure turbine section and the downstream valves are governor or control valves for the high pressure turbine section, and the steam flow demand is a demand which corresponds to a load demand.

9. A steam turbine arrangement as set forth in claim 8 wherein a digital control computer is provided, said computer including means for generating main inlet valve operating signals and a main inlet valve test closure signal to function as part of said main inlet valve operating means, and said digital computer further including means for generating feedforward downstream position signals and downstream test closure signals to function as part of the generating and positioning means.

10. A steam turbine arrangement as set forth in claim 9 wherein the nonlinear characterization is a representation of a flow curve corrected by flow coefficient as a function of load level and said modifying means selects for implementation by said computer generating means a representation of the flow curve applicable to the load existing as the test is ended.

11. A steam turbine arrangement as set forth in claim 10 wherein said computer generating means generates the downstream test closure signals as ramp signals.

12. An electric power plant comprising a generator for producing electric power and a steam turbine arrangement to drive said generator as set forth in claim 3.

13. A electric power plant including a generator for producing electric power and a steam turbine arrangement as set forth in claim 7.

14. A test system for a steam turbine inlet valve configuration including at least two main inlet valves and a plurality of position controllable valves downstream from each main inlet valve, said test system comprising means for positioning the downstream valves to satisfy a steam flow demand in a sequential valve mode or a single valve mode, said positioning means including means for transferring the downstream valves between sequential and single valve operating modes during turbine load operations and prior to a main inlet valve test in a bumpless manner, means for closing and reopening the downstream valves associated with a main inlet valve to be tested as said positioning means operates the downstream valves to satisfy steam flow demand substantially without disturbing generated power, and means for operating said main inlet valve operating means to close and reopen the main inlet valve to be tested after closure and prior to reopening of the downstream valve.

15. A test system for a steam turbine inlet valve configuration including at least two main inlet valves and a plurality of position controllable valves downstream from each main inlet valve, said system including means for operating said main inlet valves, means for generating feedforward signals representative of the positions of said downstream valves needed to satisfy a steam flow demand, means for positioning said downstream valves in accordance with the feedforward position signals, means for closing and reopening the downstream valves associated with a main inlet valve to be tested as said generating and positioning means operate the downstream valves to satisfy steam flow demand substantially without disturbing the turbine load generation, and means for operating said main inlet valve operating means to close and reopen the main inlet valve to be tested after closure and prior to reopening of the associated downstream valves.

16. A test system as set forth in claim 15 wherein a digital control computer is provided, said computer including means for generating main inlet valve operating signals and main inlet valve test closure signals to function as part of said main inlet valve operating means, and said digital computer further including means for generating feedforward downstream position signals and downstream test closure signals to function as part of said generating and positioning means.

17. A test system as set forth in claim 15 wherein said feedforward generating means generates feedforward position signals in accordance with a nonlinear characterization during normal operation and in accordance with a substantially linear characterization during test operation, and means are provided for modifying said feedforward computer generator means so that it functions with the nonlinear characterization to generate feedforward position signals which satisfy existing steam flow demand in accordance with the nonlinear characterization as the valve test is ended.

18. A method for operating an electric power generating plant comprising operating a steam turbine at synchronous speed to drive an electric generator and produce electric power, operating at least two main inlet valves and a plurality of governor valves downstream from each main inlet valve to supply inlet steam to the turbine, operating a governor valve control system to operate the governor valves in a sequential valve mode and meet load demand at relatively low load levels, operating the governor valve control system to transfer the governor valve operation from the sequential valve mode to the signal valve mode on line while satisfying load demand preparatory to a throttle valve test, operating the governor valve control system to operate the governor valves in the single valve mode after the transfer, operating the governor valve control system to close the governor valves downstream from the main inlet valve to be tested while operating governor valves to satisfy the load demand, operating a main inlet valve control system to close and reopen the main inlet valve to be tested after closure of the associated downstream valves, and operating the governor valve control system to reopen the closed governor valves while satisfying load demand after the main inlet valve test.

19. A method as set forth in claim 18 wherein the governor valve control system is operated to generate feedforward signals representing the positions of the downstream governor valves needed to satisfy load demand.

* * * * *